US007088203B2

(12) United States Patent
Pance et al.

(10) Patent No.: US 7,088,203 B2
(45) Date of Patent: Aug. 8, 2006

(54) SLOTTED DIELECTRIC RESONATORS AND CIRCUITS WITH SLOTTED DIELECTRIC RESONATORS

(75) Inventors: Kristi Dhimiter Pance, Auburndale, MA (US); Eswarappa Channabasappa, Acton, MA (US)

(73) Assignee: M/A-COM, Inc., Lowell, MA (US)

( * ) Notice: Subject to any disclaimer, the term of this patent is extended or adjusted under 35 U.S.C. 154(b) by 0 days.

(21) Appl. No.: 10/833,630

(22) Filed: Apr. 27, 2004

(65) Prior Publication Data

US 2005/0237135 A1 Oct. 27, 2005

(51) Int. Cl.
*H01P 7/10* (2006.01)

(52) U.S. Cl. ..... 333/219.1; 333/202

(58) Field of Classification Search ..... 333/202, 333/219, 219.1

See application file for complete search history.

(56) References Cited

U.S. PATENT DOCUMENTS

| | | | | |
|---|---|---|---|---|
| 3,475,642 | A | 10/1969 | Karp et al. | 315/3.5 |
| 4,028,652 | A | 6/1977 | Wakino et al. | 333/73 W |
| 4,138,652 | A | 2/1979 | Nishikawa et al. | 333/82 R |
| 4,267,537 | A | 5/1981 | Karmel | |
| 4,283,649 | A | 8/1981 | Heinouchi | 310/324 |
| 4,423,397 | A | 12/1983 | Nishikawa et al. | |
| 4,459,570 | A | 7/1984 | Delaballe et al. | 333/202 |
| 4,477,785 | A | 10/1984 | Atia | 333/202 |
| 4,578,655 | A | 3/1986 | Etienne et al. | 333/202 |
| 4,620,168 | A | 10/1986 | Delestre et al. | 333/202 |
| 4,661,790 | A | 4/1987 | Gannon et al. | 333/234 |
| 4,757,289 | A | 7/1988 | Kosugi et al. | 333/209 |
| 4,810,984 | A | 3/1989 | Arnold et al. | |
| 4,821,006 | A | 4/1989 | Ishikawa et al. | |
| 4,835,498 | A | 5/1989 | Rouger et al. | 333/205 |
| 4,881,051 | A | 11/1989 | Tang et al. | |
| 5,059,929 | A | 10/1991 | Tanaka | 333/219.1 |
| 5,109,207 | A | 4/1992 | Aizawa et al. | 333/222 |
| 5,140,285 | A | 8/1992 | Cohen | 331/96 |
| 5,218,330 | A | 6/1993 | Omiya et al. | 333/223 |
| 5,347,246 | A | 9/1994 | Bellows et al. | 333/219 |
| 5,525,945 | A | 6/1996 | Chiappetta et al. | 333/202 |
| 5,614,875 | A | 3/1997 | Jang et al. | 333/202 |
| 5,691,677 | A | 11/1997 | De Maron et al. | 333/219.1 |
| 5,748,058 | A | 5/1998 | Scott | 333/202 |
| 5,777,534 | A | 7/1998 | Harrison | 333/202 |

(Continued)

FOREIGN PATENT DOCUMENTS

EP 0 492 304 A1 7/1992

(Continued)

OTHER PUBLICATIONS

Hui et al., "DielectricRing-Gap Resonator for Application in MMIC's", IEEE Transactions on Microwave theory & Techniques, vol. 39, No. 12, Nov. 1991, pp. 2061-2068.*

(Continued)

*Primary Examiner*—Seungsook Ham

(57) ABSTRACT

In accordance with the principles of the present invention, a resonator puck is provided with one or more vertical and/or horizontal, radial slits that improve the quality factor, Q, of circuits constructed from the resonators. Preferably, the slits are very narrow and, more preferably, about 100 to 1000 atoms wide. In some preferred embodiments of the invention, the surfaces of the resonators that define the slit are left relatively rough and may even contact each other such that the slit is not of uniform thickness, but essentially comprises a plurality of pockets between the two portions of the resonator.

25 Claims, 33 Drawing Sheets

U.S. PATENT DOCUMENTS

| | | | | |
|---|---|---|---|---|
| 5,841,330 | A | 11/1998 | Wenzel et al. | 333/202 |
| 5,859,574 | A | 1/1999 | Schmitt | |
| 5,949,309 | A | 9/1999 | Correa | 333/202 |
| 5,990,767 | A | 11/1999 | Ivanov et al. | 333/219.1 |
| 6,087,910 | A | 7/2000 | Matsumoto et al. | |
| 6,100,703 | A | 8/2000 | Davidov et al. | |
| 6,111,339 | A | 8/2000 | Ohya et al. | 310/358 |
| 6,208,227 | B1 | 3/2001 | Remillard et al. | 333/219 |
| 6,254,708 | B1 | 7/2001 | Cappabianca | |
| 6,262,639 | B1 | 7/2001 | Shu et al. | 333/202 |
| 6,337,664 | B1 | 1/2002 | Mayes et al. | |
| 6,402,981 | B1 | 6/2002 | Sasaki | 252/62.9 PZ |
| 6,707,353 | B1 | 3/2004 | Yamakawa et al. | 333/202 |
| 6,717,490 | B1 | 4/2004 | Mayer | |
| 6,784,768 | B1 | 8/2004 | Pance et al. | 333/219 |
| 2004/0051602 | A1 | 3/2004 | Pance et al. | 333/202 |
| 2004/0051603 | A1 | 3/2004 | Pance et al. | 333/202 |

FOREIGN PATENT DOCUMENTS

| | | | | |
|---|---|---|---|---|
| EP | 0 601 370 | A1 | | 6/1994 |
| EP | 1 162 684 | A3 | | 12/2001 |
| EP | 1 181 740 | B1 | | 3/2003 |
| GB | 1 376 938 | | | 12/1974 |
| GB | 1 520 473 | | | 8/1978 |
| JP | 57-14202 | | | 1/1982 |
| JP | 59-202701 | | | 11/1984 |
| JP | 01-144701 | | | 6/1989 |
| JP | 02-042898 | A | | 2/1990 |
| JP | 02-137502 | | | 5/1990 |
| JP | 02-168702 | | | 6/1990 |
| JP | 05102714 | A | * | 4/1993 |
| JP | 05-267940 | | | 10/1993 |
| JP | 07-154116 | | | 6/1995 |
| JP | 07154114 | A | * | 6/1995 |
| JP | 2003249803 | A | * | 9/2003 |
| WO | WO 00/70706 | | | 11/2000 |
| WO | WO 01/43221 | | | 6/2001 |
| WO | WO 04/027917 | A3 | | 4/2004 |

OTHER PUBLICATIONS

Kishk et al., "Conical Dielectric Resonator Antennas for Wide-Band Applications," IEEE Transactions on Antennas and Propogation, 50(4);469-474 (2002).

D. Kajfez and P. Guillon "Dielectric Resonators", ISBN 0-89006-201-3, Publisher Artech House, Dedham, MA 1986, pp. 298-317.

E. J. Heller, "Quantum Proximity Resonances", Physical Review Letters, vol. 77, No. 20, Nov. 11, 1966 The American Physical Society, pp. 4122-4125.

K. Pance et al., "Tunneling Proximity Resonances: Interplay Between Symmetry and Dissipation", Physics Department, Northwestern University Aug. 2, 1999, T-143, pp. 16-18, F426.

J. S. Hersch et al., "Observation of Proximity Resonances in a Parallel-Plate Waveguide", Physical Review Letters, vol. 81, No. 15, Oct. 12, 1998, The American Physical Society, pp. 3059-3062.

M. A. Gerdine, "A Frequency-Stabilized Microwave Band-Rejection Filter Using High Dielectric Constant Resonators", IEEE Transactions on Microwave Theory and Techniques, vol. MTT-17, No. 7, Jul. 1969, pp. 354-359.

S. Verdeyme & P. Guillon, "New Direct Coupling Configuration Between $TE_{010}$ Dielectric Resonator Modes" Electronics Letters, May 25, 1989, vol. 25 No. 11, pp. 693-694.

T. Nishikawa et al., "Dielectric High-Power Bandpass Filter Using Quarter-Cut $TE_{010}$ Image Resonator for Cellular Base Stations", IEEE Transactions on Microwave Theory and Techniques, vol. MTT-35, No. 12, Dec. 1987, pp. 1150-1155.

* cited by examiner

| | Frequency (GHz) | Q |
|---|---|---|
| Mode 1 | ( 1.14936e+000, 1.59314e−005) | 3.60724e+004 |
| Mode 2 | ( 1.31411e+000, 1.79650e−005) | 3.65741e+004 |
| Mode 3 | ( 1.31428e+000, 1.79664e−005) | 3.65760e+004 |
| Mode 4 | ( 1.55660e+000, 2.15554e−005) | 3.61069e+004 |
| Mode 5 | ( 1.59194e+000, 2.20105e−005) | 3.61631e+004 |

Plain Resonator
Q−36000 at 1.149GHz

| | Frequency (GHz) | Q |
|---|---|---|
| Mode 1 | ( 1.25044e+000, 1.46169e-005) | 4.27738e+004 |
| Mode 2 | ( 1.38679e+000, 1.71555e-005) | 4.04181e+004 |
| Mode 3 | ( 1.38720e+000, 1.71551e-005) | 4.04312e+004 |
| Mode 4 | ( 1.60527e+000, 2.22016e-005) | 3.61522e+004 |
| Mode 5 | ( 1.67319e+000, 2.10253e-005) | 3.97900e+004 |

4 slots, gap 0.1mm
Q−42000

| | Frequency (GHz) | Q |
|---|---|---|
| Mode 1 | ( 1.34146e+000, 1.36360e-005) | 4.91881e+004 |
| Mode 2 | ( 1.45483e+000, 1.62833e-005) | 4.46723e+004 |
| Mode 3 | ( 1.45622e+000, 1.62667e-005) | 4.47608e+004 |
| Mode 4 | ( 1.67396e+000, 2.10798e-005) | 3.97051e+004 |
| Mode 5 | ( 1.67952e+000, 2.11980e-005) | 3.96150e+004 |

Q−49000 at 1.341GHz
Loss Tangent: 1/37000
8 slots, gap 0.1mm

| | Frequency (GHz) | Q |
|---|---|---|
| Mode 1 | ( 1.50609e+000, 1.20701e−005) | 6.23893e+004 |
| Mode 2 | ( 1.58679e+000, 1.49008e−005) | 5.32454e+004 |
| Mode 3 | ( 1.58852e+000, 1.48669e−005) | 5.34246e+004 |

Q~62000 at 1.506GHz
Loss Tangent: 1/37000
16 slots, gap 0.1mm

| | Frequency (GHz) | Q |
|---|---|---|
| Mode 1 | ( 2.06653e+000, 2.36483e−004) | 4.36929e+003 |
| Mode 2 | ( 2.79152e+000, 2.97270e−004) | 4.69527e+003 |

Q−8150 at 3.005GHz
Loss Tangent: 1/5000
16 slots, gap 0.05mm

| | Frequency (GHz) | Q |
|---|---|---|
| Mode 1 | ( 3.00537e+000, 1.84191e−004) | 8.15827e+003 |
| Mode 2 | ( 3.63860e+000, 2.59431e−004) | 7.01265e+003 |

Q−8150 at 3.005GHz
Loss Tangent: 1/5000
16 slots, gap 0.05mm

| | Frequency (GHz) | Q |
|---|---|---|
| Mode 1 | ( 3.60093e+000, 1.73466e−004) | 1.03793e+004 |
| Mode 2 | ( 3.77398e+000, 3.13658e−004) | 6.01608e+003 |

Q−10300 at 3.600GHz
Loss Tangent: 1/5000
16 slots, gap 0.1mm

| | Frequency (GHz) | Q |
|---|---|---|
| Mode 1 | ( 1.96286e+000, 2.03282e−004) | 4.82795e+003 |
| Mode 2 | ( 2.69060e+000, 2.67775e−004) | 5.02400e+003 |

Q−4800 at 1.960GHz

| | Frequency (GHz) | Q |
|---|---|---|
| Mode 1 | ( 2.85793e+000, 1.57173e−004) | 9.09165e+003 |
| Mode 2 | ( 3.97407e+000, 2.25228e−004) | 8.82232e+003 |

Q−9000 at 2.860GHz
Loss Tan=1/5000
8 gaps of 0.1mm

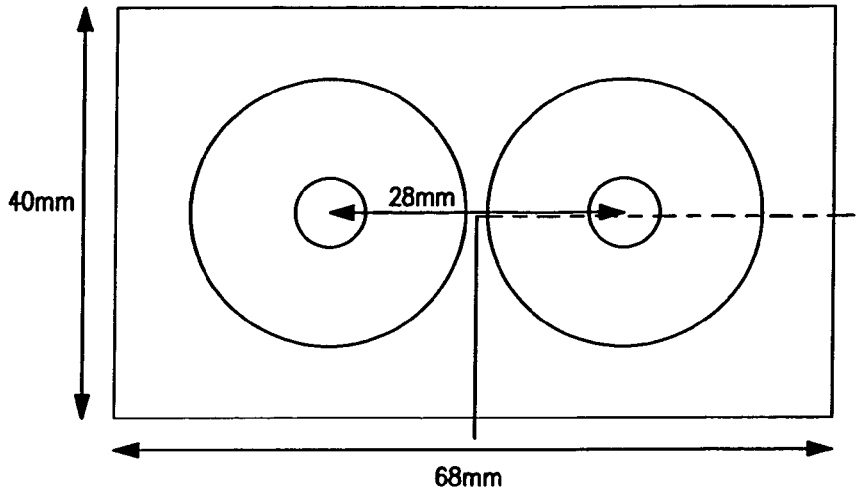
FIG. 16A
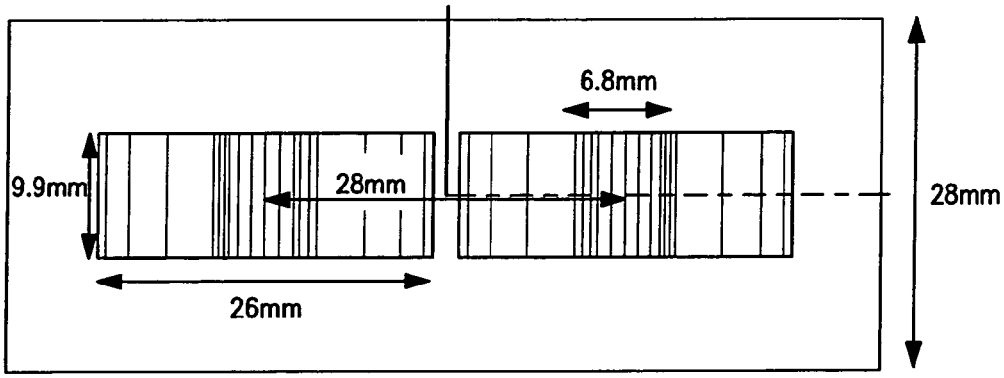
FIG. 16B
| | Frequency (GHz) | Q |
|---|---|---|
| Mode 1 | ( 1.98764e+000, 4.15241e-005) | 2.39335e+004 |
| Mode 2 | ( 2.09780e+000, 4.29432e-005) | 2.44253e+004 |
FIG. 16C

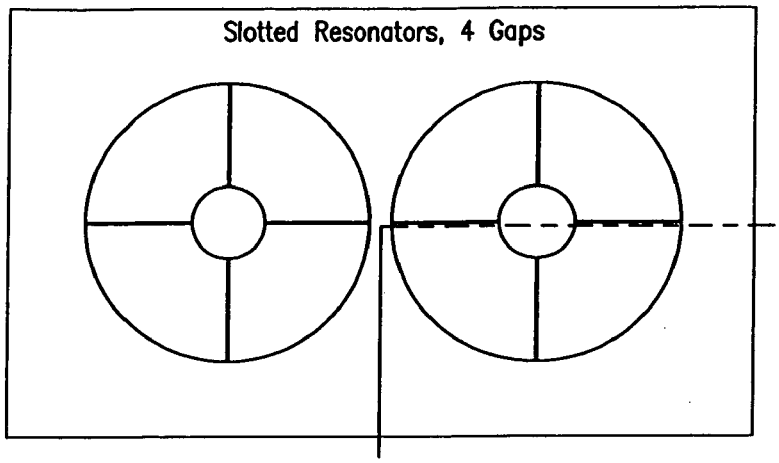
FIG. 17A
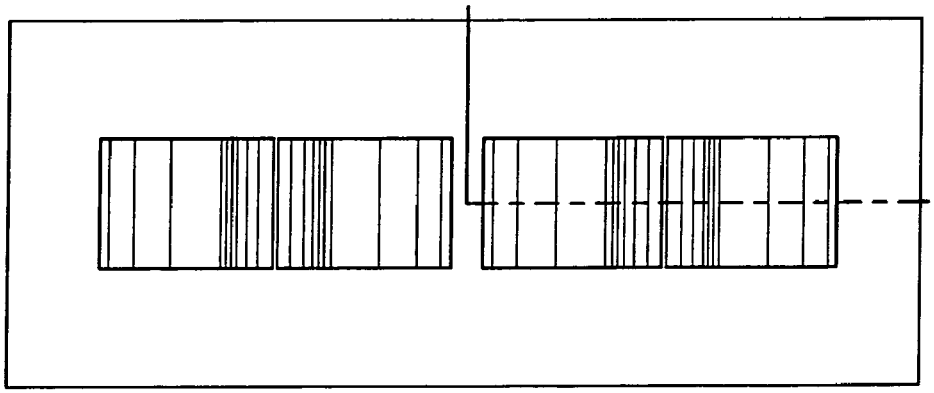
FIG. 17B
| | Frequency (GHz) | Q |
|---|---|---|
| Mode 1 | ( 2.39194e+000, 4.11379e−005) | 2.90722e+004 |
| Mode 2 | ( 2.54209e+000, 4.25377e−005) | 2.98804e+004 |
FIG. 17C

SLOTTED DIELECTRIC RESONATORS AND CIRCUITS WITH SLOTTED DIELECTRIC RESONATORS

FIELD OF THE INVENTION

The invention pertains to dielectric resonators, such as those used in microwave circuits for concentrating electric fields, and to the circuits made from them, such as microwave filters.

BACKGROUND OF THE INVENTION

Dielectric resonators are used in many circuits, particularly microwave circuits, for concentrating electric fields. They can be used to form filters, oscillators, triplexers, and other circuits. The higher the dielectric constant of the dielectric material out of which the resonator is formed, the smaller the space within which the electric fields are concentrated. Suitable dielectric materials for fabricating dielectric resonators are available today with dielectric constants ranging from approximately 10 to approximately 150 (relative to air). These dielectric materials generally have a mu (magnetic constant, often represented as $\mu$) of 1, i.e., they are transparent to magnetic fields.

FIG. 1 is a perspective view of a typical cylindrical or doughnut-type dielectric resonator of the prior art that can be used to build dielectric resonator circuits such as filters. As can be seen, the resonator 10 is formed as a cylinder 12 of dielectric material with a circular, longitudinal through hole 14. Individual resonators are commonly called "pucks" in the relevant trade. While dielectric resonators have many uses, their primary use is in connection with microwaves and particularly, in microwave communication systems and networks.

As is well known in the art, dielectric resonators and resonator filters have multiple modes of electrical fields and magnetic fields concentrated at different center frequencies. A mode is a field configuration corresponding to a resonant frequency of the system, as determined by Maxwell's equations. In a typical dielectric resonator circuit, the fundamental resonant mode, i.e., the field having the lowest frequency, is the transverse electric field mode, $TE_{01}$ (or TE, hereafter). The electric field 31 of the TE mode is circular and is oriented transverse of the cylindrical puck 12. It is concentrated around the circumference of the resonator 10, with some of the field inside the resonator and some of the field outside the resonator. A portion of the field should be outside the resonator for purposes of coupling between the resonator and other microwave devices (e.g., other resonators or input/output couplers) in a dielectric resonator circuit.

It is possible to arrange circuit components so that a mode different than the TE mode is the fundamental mode of the circuit and this, in fact, is done sometimes in dielectric resonator circuits. Also, while typical, there is no requirement that the fundamental mode be used as the operational mode of a circuit, e.g., the mode within which the information in a communications circuit is contained.

The second mode (i.e., the mode having the second lowest frequency) normally is the hybrid mode, $H_{11}$ (or $H_{11}$ mode hereafter). The next lowest-frequency mode usually is the transverse magnetic (or TM) mode. There are additional higher order modes. Typically, all of the modes other than the fundamental mode, e.g., the TE mode, are undesired and constitute interference. The $H_{11}$ mode, however, typically is the only interference mode of significant concern, particularly during tuning of dielectric resonator circuits. However, the transverse Magnetic TM mode sometimes also can interfere with the TE mode. The remaining modes usually have substantial frequency separation from the TE mode and thus do not cause significant interference with operation of the system. The $H_{11}$ mode, however, tends to be rather close in frequency to the TE mode and thus can be difficult to distinguish from the TE mode in operation. In addition, as the frequency and bandwidth (which is largely dictated by the coupling between electrically adjacent dielectric resonators) of the TE mode is tuned, the center frequency of the TE mode and the $H_{11}$ mode move in opposite directions to each other. Thus, as the TE mode is tuned to increase its center frequency, the center frequency of the $H_{11}$ mode inherently moves downward and, thus, closer to the TE mode center frequency.

FIG. 2 is a perspective view of a microwave dielectric resonator filter 20 of the prior art employing a plurality of dielectric resonators 10. The resonators 10 are arranged in the cavity 22 of an enclosure 24. Microwave energy is introduced into the cavity via a coupler 28 coupled to a cable, such as a coaxial cable. Conductive separating walls 32 separate the resonators from each other and block (partially or wholly) coupling between physically adjacent resonators 10. Particularly, irises 30 in walls 32 control the coupling between adjacent resonators 10. Walls without irises generally prevent any coupling between adjacent resonators. Walls with irises allow some coupling between adjacent resonators. By way of example, the field of resonator 10*a* couples to the field of resonator 10*b* through iris 30*a*, the field of resonator 10*b* further couples to the field of resonator 10*c* through iris 30*b*, and the field of resonator 10*c* further couples to the field of resonator 10*d* through iris 30*c*. Wall 32*a*, which does not have an iris, prevents the field of resonator 10*a* from coupling with physically adjacent resonator 10*d* on the other side of the wall 32*a*. Conductive adjusting screws may be placed in the irises to further affect the coupling between the fields of the resonators and provide adjustability of the coupling between the resonators, but are not shown in the example of FIG. 2.

One or more metal plates 42 may be attached by screws 43 to the top wall (not shown for purposes of clarity) of the enclosure to affect the field of the resonator and help set the center frequency of the filter. Particularly, screws 43 may be rotated to vary the spacing between the plate 42 and the resonator 10 to adjust the center frequency of the resonator. An output coupler 40 is positioned adjacent the last resonator 10*d* to couple the microwave energy out of the filter 20 and into a coaxial connector (not shown). Signals also may be coupled into and out of a dielectric resonator circuit by other methods, such as microstrips positioned on the bottom surface 44 of the enclosure 24 adjacent the resonators. The sizes of the resonator pucks 10, their relative spacing, the number of pucks, the size of the cavity 22, and the size of the irises 30 all need to be precisely controlled to set the desired center frequency of the filter and the bandwidth of the filter. More specifically, the bandwidth of the filter is controlled primarily by the amount of coupling of the electric and magnetic fields between the electrically adjacent resonators. Generally, the closer the resonators are to each other, the more coupling between them and the wider the bandwidth of the filter. On the other hand, the center frequency of the filter is controlled largely by the size of the resonators themselves and the size of the conductive plates 42 as well as the distance of the plates 42 from their corresponding resonators 10. Generally, as the resonator gets larger, its center frequency gets lower.

Prior art resonators and the circuits made from them have many drawbacks. For instance, prior art dielectric resonator circuits such as the filter shown in FIG. 2 suffer from poor quality factor, Q, due to the presence of many separating walls and coupling screws. Q essentially is an efficiency rating of the system and, more particularly, is the ratio of stored energy to lost energy in the system. The fields generated by the resonators pass through all of the conductive components of the system, such as the enclosure 20, plates 42, internal walls 32 and 34, and adjusting screws 43, and inherently generate currents in those conductive elements. Those currents essentially comprise energy that is lost to the circuit.

Furthermore, the volume and configuration of the conductive enclosure 24 substantially affects the operation of the system. The enclosure minimizes radiative loss. However, it also has a substantial effect on the center frequency of the TE mode. Accordingly, not only must the enclosure usually be constructed of a conductive material, but also it must be very precisely machined to achieve the desired center frequency performance, thus adding complexity and expense to the fabrication of the system. Even with very precise machining, the design can easily be marginal and fail specification.

Even further, prior art resonators tend to have poor mode separation between the TE mode and the $H_{11}$ mode.

Accordingly, it is an object of the present invention to provide improved dielectric resonators.

It is another object of the present invention to provide improved dielectric resonator circuits.

It is a further object of the present invention to provide dielectric resonator circuits with improved quality factor, Q.

SUMMARY OF THE INVENTION

In accordance with the principles of the present invention, a resonator puck is provided with one or more radial, vertical and/or horizontal slits. Preferably, the slits are very narrow and, more preferably, from about 100 atoms wide to 20 mils. In some preferred embodiments of the invention, the surfaces of the resonators that define each slit are not polished smooth, but are left relatively rough whereby the slits are not of uniform thickness on the microscopic scale. In essence, each slit has an average width (which is variable on the microscopic scale, but essentially uniform on the macroscopic scale). The surfaces that define each slit may even contact each other, whereby the slit essentially comprises a plurality of pockets between the high points of the two surfaces that define the slit. Maxwell's equations can be applied using the average distance between the two surfaces that define the slit to determine the behavior of the circuit.

Taking as an example a resonator with radial, vertical slits utilizing the TE mode as the fundamental mode, Maxwell's equations disclose that the horizontal electric field of the TE mode that cuts through the vertical slits will be $\in$ times greater in the slit (e.g., in the air that fills the slit) than in the resonator, where $\in$ is the dielectric constant of the resonator material. This means that the energy density is $\in$ times higher in the slits than in the resonator. This increases the Q of the circuit. The electric component of the TE field decays exponentially outside of the resonator material (i.e., in the slits). Therefore, the slits should be narrow enough that the field attenuation in the slits is minimal.

Generally, as the number of slits increases, the Q also increases. Also, the width of the slit significantly effects operation. Particularly, wider slits increase Q because more energy is stored without loss outside of the dielectric resonator material. However, the field decays rapidly outside of the material which pushes the frequency up. This latter effect is dominant, such that the best trade-off is often to provide many narrow slits rather than a few wide slits. By having many narrow regions, the field is stored with minimal decay in many places and the increment in Q dominates over the frequency increase.

The slits also have the effect of increasing the center frequency of the resonator. If this is undesired, it can be recompensed, if necessary, by increasing the size of the resonator puck to lower the center frequency back down to the desired frequency. However, even though the size of the resonator puck might be enlarged, the dimensions of the housing actually may be decreased because they can be placed much closer to the resonators than in conventional designs. Specifically, the fields are more concentrated in the dielectric resonators (and the slits) relative to conventional dielectric resonator circuits. Accordingly, the circuit housing actually may be reduced in size relative to a conventional circuit design, even though the resonators may have been increased in size.

If the increase in frequency of the fundamental TE mode brings the fundamental TE mode too close to the next higher order mode, e.g., the $H_{11}$ mode, then one or more horizontal slits may be added to the resonator. Specifically, the field lines of the electric field of the $H_{11}$ mode are vertical through the resonator. Therefore, the horizontal slit(s) will have the effect of increasing the frequency of the $H_{11}$ mode, thus moving it further away from the TE mode.

The horizontal slits will have essentially no effect on the TE mode because the electric field of the TE mode is parallel to the horizontal slits. Particularly, a slit, whether horizontal or vertical, essentially has no effect on fields that are parallel to it.

Generally, the slits should be perpendicular to the lines of the field that is to be affected by the slit. Specifically, the further the field lines are from perpendicular to a slit, the lower the gain in Q and the greater the decay of the field (because the air gap that it traverses is wider).

BRIEF DESCRIPTION OF THE DRAWINGS

FIG. 16A is a dimensioned top plan view representing a conventional, two-pole, cylindrical resonator circuit design.

FIG. 16B is a dimensioned elevation view of the resonator circuit design of FIG. 16A.

FIG. 16C is table showing the frequencies of the two lowest frequency modes of the resonator circuit design of FIG. 16A.

FIGS. 17A–17C are figures corresponding in content to FIGS. 16A–16C, but pertaining to a dielectric resonator circuit design identical to the dielectric resonator circuit design of FIGS. 16A–16C, except for the addition of four, equally-spaced, vertical, radial, through slits of 0.2 mm width.

DETAILED DESCRIPTION OF THE INVENTION

Figure 1:
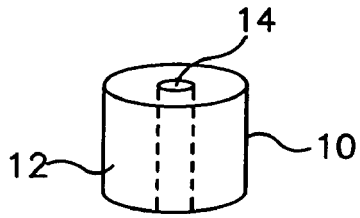
FIG. 1 PRIOR ART
FIG. 1 is a perspective view of an exemplary conventional cylindrical dielectric resonator.
Figure 2:
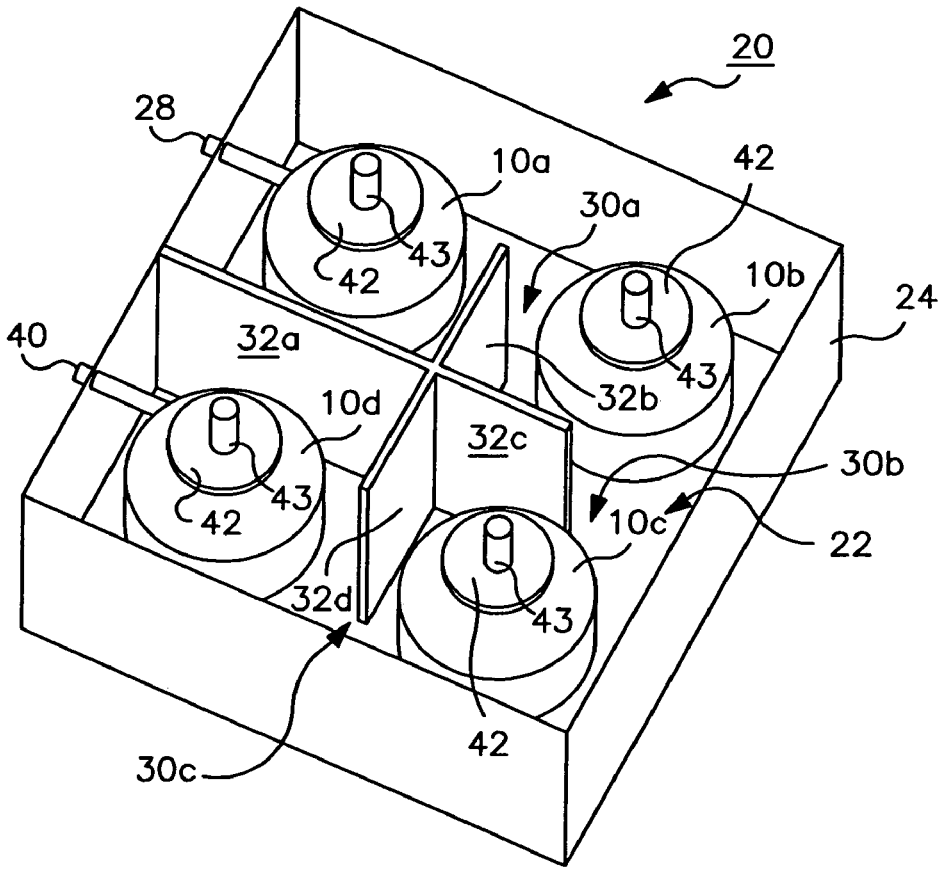
FIG. 2 PRIOR ART
FIG. 2 is a perspective view of an exemplary conventional microwave dielectric resonator filter circuit.
Figure 3A:
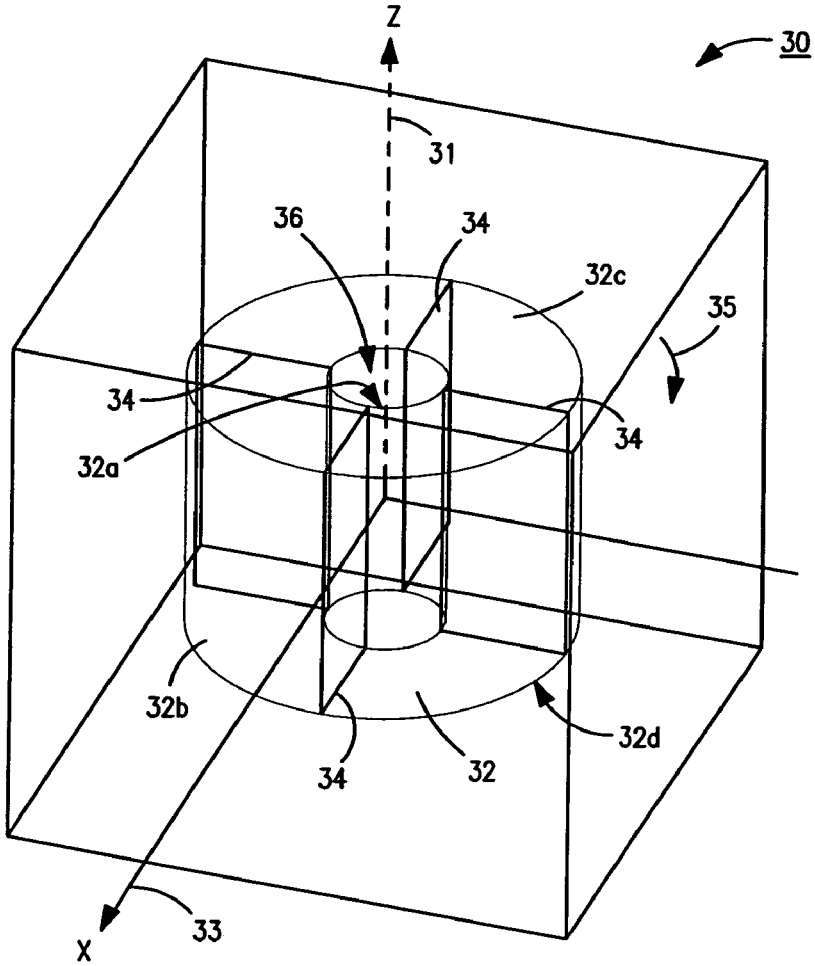
FIG. 3A is a transparent isometric view of a cylindrical resonator having vertical, radial, full slits in accordance with one embodiment of the present invention.
Figure 3B:
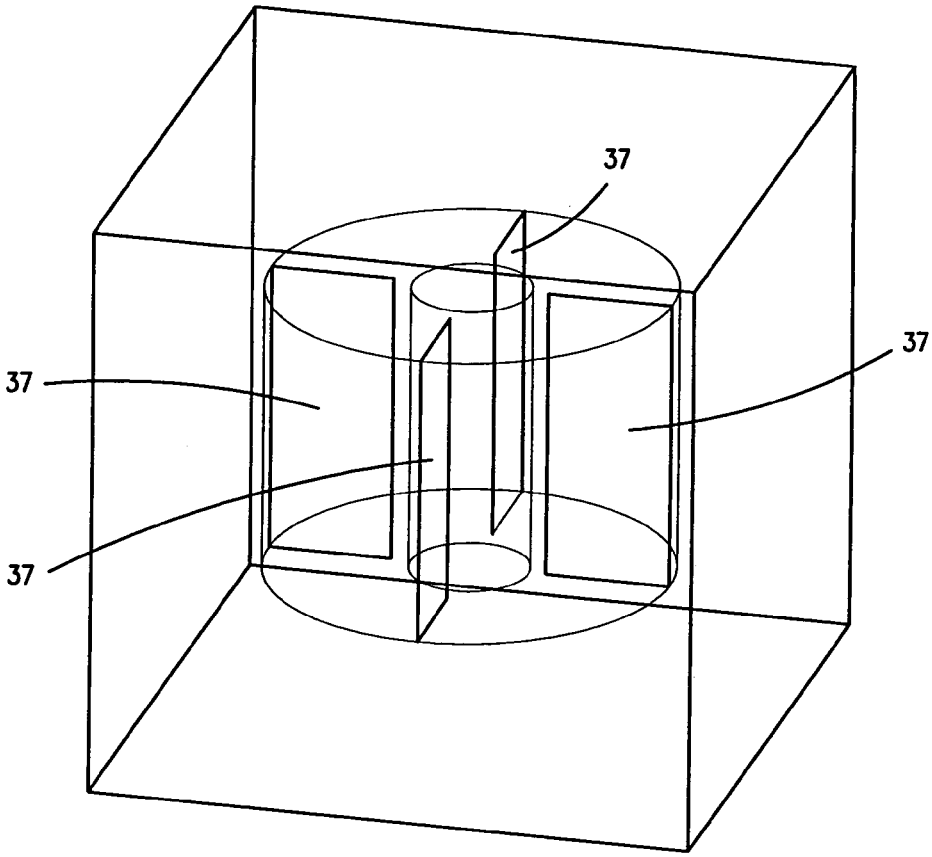
FIG. 3B is a transparent isometric view of a cylindrical resonator having vertical, radial, blind slits in accordance with another embodiment of the present invention.
Figure 3C:
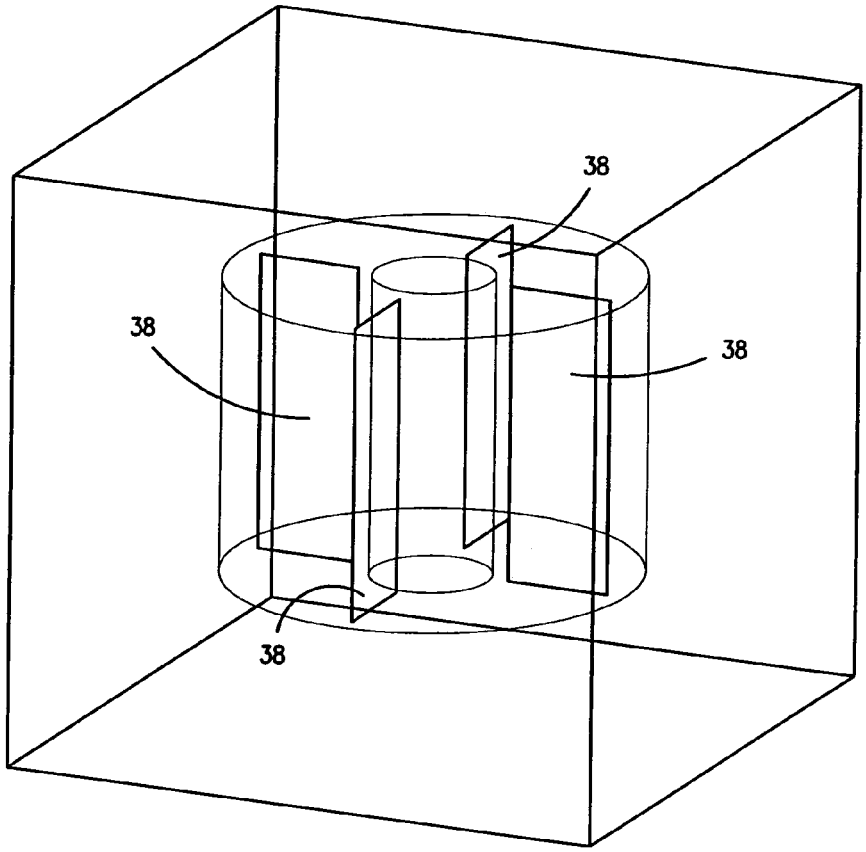
FIG. 3C is a transparent isometric view of a cylindrical resonator having vertical, radial, double blind slits in accordance with another embodiment of the present invention.
Figure 3D:
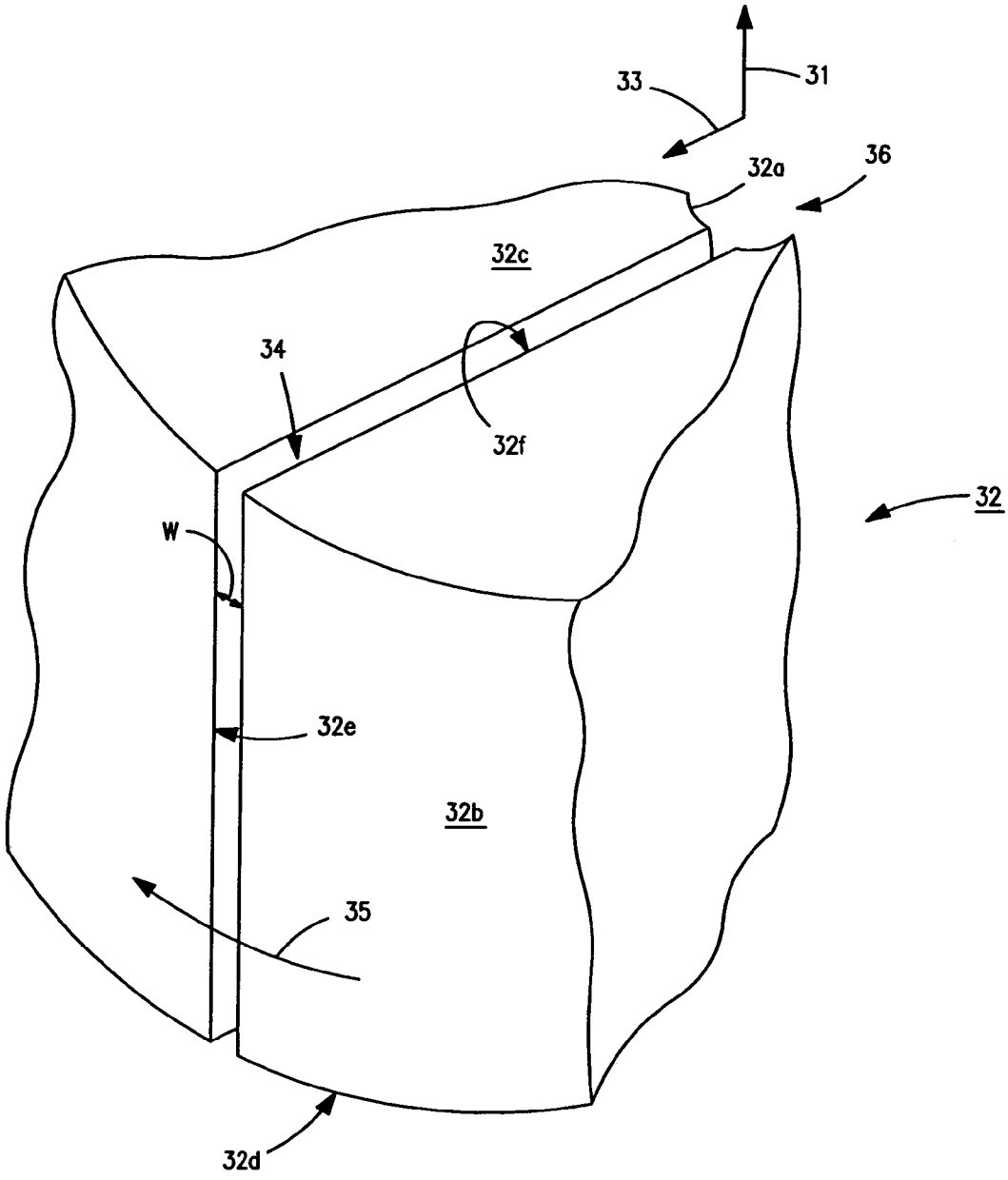
FIG. 3D is an enlarged, cut-away, solid, isometric view of a portion of the resonator 32 of FIG. 3A.

FIG. 3A is a transparent isometric view of a dielectric resonator circuit 30 in accordance with a first embodiment of the present invention. FIG. 3D is an enlarged, cut-away, solid, isometric view of a portion of the resonator 32 of FIG. 3A. Generally, resonators are cylindrical or toroidal in shape and, therefore, have a longitudinal axis orthogonal to the circumference of the cylinder or torroid. For instance, the longitudinal axis is shown at 31 in FIGS. 3A and 3D. For the sake of simplicity herein, we will refer to the direction of the longitudinal axis as the vertical direction and the direction orthogonal to the longitudinal axis as the horizontal direction. Furthermore, we shall refer to the horizontal direction pointing outward from the longitudinal axis of the resonator (as illustrated by arrows 33 in FIGS. 3A and 3D) as the radial direction. Finally, the circular direction around the longitudinal axis of a dielectric resonator (as illustrated by arrow 35 in FIGS. 3A and 3D) is generally termed the phi direction in the relevant trade. In addition, conical resonators and resonators of other shapes have been newly developed, as disclosed in U.S. patent application Ser. No. 10/268,415, which is fully incorporated herein by reference. Resonators of these shapes also are covered herein and the above directional terminology applies to resonators of those shapes as well.

Mode structure studies show that all modes in dielectric resonator circuits can be classified and represented in terms of magnetic dipoles (hereinafter "TE-multiples" or "magnetic-like" modes) and electric dipoles (hereinafter "TM-multiples" or "electric-like" modes). In brief, the transverse electric (TE) mode and its multiples are magnetic-like modes. For magnetic-like modes, the electric field lines of the mode lie in the horizontal plane of the dielectric resonators and the magnetic field lines lie normal to the horizontal plane (i.e., vertical).

Electric-like modes include the transverse magnetic (TM) mode and its multiples. Their field orientations are exactly opposite to the magnetic-like mode. Particularly, the lines of the magnetic field lie in the horizontal plane while the lines of the electric field of such modes lie in the vertical plane.

The present invention relates to the selective incorporation of slits into the dielectric resonator circuits. This tends to increase the quality factor, Q, of dielectric resonator circuits incorporating such resonators, among other advantages. The slits should be positioned so that the electric field lines of the fundamental mode of the circuit traverse the narrow dimension of the slit.

Hence, with respect to magnetic-like fields, such as the TE mode electric field, in which the electric field is in the horizontal plane and the field lines are in the phi direction, radial, vertical slits will be cut orthogonally by the electric field of the TE mode. Accordingly, if it is a goal to increase the quality factor for the TE mode in a dielectric resonator circuit, then one or more vertical slits can be added to the resonator.

The circuit of FIGS. 3A and 3D is adapted to increase Q for the TE mode. In this embodiment, four equally spaced vertical, radial slits 34 have been cut into the resonator 32. As shown in FIGS. 3A and 3D, the slits 34 run the entire radial depth of the resonator from the inner circumferential surface 32*a* of the resonator defined by the central longitudinal through hole 36 to the outer circumferential surface 32*b*. It also runs completely from the top horizontal surface 32*c* to the bottom horizontal surface 32*d*. This type of slit that runs from the inner circumferential surface to the outer circumferential surface is hereinafter termed a "full slit". A full slit is merely exemplary. The slits do not need to run the entire radial depth of the resonator. They may run from either the outer circumferential surface 32*b* or the inner circumferential surface 32*a* only partially through the depth of the resonator (hereinafter termed "a blind slit"), as illustrated by slits 37 in FIG. 3B. Even further, the slit may be entirely internal in the radial direction, i.e., it does not reach either the outer circumferential surface 32*b* or the inner circumferential surface 32*a* (hereinafter termed a "double blind" slit), as illustrated by slits 38 in FIG. 3C. In accordance with other embodiments, the slits do not need to run the complete vertical distance between the top and bottom surfaces 32*c* and 32*d* of the resonator. That is, the slit may be blind or double blind in the vertical direction also. Slits of any permutation of full, blind or double blind in the radial direction and full, blind and double blind in the vertical direction would be consistent with the present invention. In fact, the slit could be entirely hidden within the resonator, reaching no external surface of the resonator puck. Furthermore, it is not even necessary that all of the slits be identical. In short, the goals of the present invention will be accomplished as long as some of the electric field lines of the mode of interest traverse at least one slit in the direction orthogonal to the plane of the slit. In fact, the field lines need not be exactly perpendicular to the plane of the slit, although this is preferred. It is sufficient merely that the field lines have a vector component perpendicular to the plane of the slit.

When a field traverses a slit, the field passes through a dielectric-to-air interface, such as at surface 32*e* in FIG. 3D, and then an air-to-dielectric interface, such as at surface 32*f*. Air has a dielectric constant of 1. Accordingly, the electric field strength in the slit will be $\in$ times higher than the electric field strength inside the dielectric resonator, where $\in$ is the dielectric constant of the resonator material. This means that the energy density as well as the field strength in the slit is $\in$ times higher than in the resonator. This energy is stored in the slit without loss because the air in the slit is lossless. However, the field decays rapidly outside of the resonator. Accordingly, by keeping the slit width, w, narrow, i.e., about 100 to 1000 atoms, the field decay is kept negligible. On the other hand, the quality factor, Q, of the circuit is increased dramatically due to the increased energy density in the slits. Generally speaking, the more slits that the electric field of a mode traverses, the greater the overall field strength and energy density and, hence, the greater the quality factor, Q, of the circuit.

Slit widths of between about 2–4 mils provide excellent performance. In fact slits as wide as 20 mils have been found to provide good performance characteristics and slit widths of 2–20 mils are much easier to machine than 100–1000 atom wide slits. The above-described aspects of the present invention holds for slit widths of any distance for which classical electrodynamics and/or Maxwell's equations in continuous media hold.

The tangential components of the electric field of the TE mode do not change regardless of whether they are inside or outside of the dielectric resonator material. The energy density is greater inside the material by a factor of $\in$, but outside there are no losses. For the normal components of the electric field of the TE mode, the field will be $\in$ times greater outside of the resonator material than inside the resonator material and the density is $\in$ times greater outside of the resonator material. Surprisingly, the perpendicular field decays exponentially relative to the radial distance from the outer circumference of the dielectric.

In accordance with Maxwell's equations, the center frequency of the circuit also should be increased by the addition of slits. The increase in frequency, however, is smaller (as a percentage) than the increase in quality factor. Generally, the increase in the frequency is about half of the increase in the quality factor.

If the increase in frequency is undesired, it can be recompensed simply by increasing the size of the resonator pucks. On the other hand, it often is desirable to increase the center frequency of a circuit during tuning of a filter. However, a problem encountered in the prior art in connection with this goal is that the increase of the frequency of the fundamental mode may move it too close to the frequency of the next mode (e.g., the $H_{11}$ mode) thereby making it difficult to clearly distinguish the two modes. In accordance with the principals of the present invention, this issue can be addressed by adding one or more horizontal slits to the resonator(s). Particularly, the vertical slits are orthogonal to the electric field lines of the TE mode. As is well known, the $H_{11}$ mode is orthogonal to the TE mode. Accordingly, the direction of the electric field lines of the $H_{11}$ mode are orthogonal to the direction of the electric field lines of the TE mode. Accordingly, the electric field of the $H_{11}$ mode traverses the horizontal slits orthogonally. Accordingly, the horizontal slits would affect the $H_{11}$ mode in essentially the same way that the first set of slits affect the TE mode, i.e., it would increase the Q factor to the $H_{11}$ mode and, more importantly, would move the $H_{11}$ mode up in frequency, i.e., further away from the TE mode. The horizontal slit(s) will have basically no effect on the TE mode because the lines of the electric field of the TE mode are parallel to the horizontal slit such that only a very small portion of the electric field of the TE mode exists in the horizontal slits.

As will be seen in some of the examples provided toward the end of this specification, much of the field generally is concentrated in the middle (both radially and vertically) of the resonator. Accordingly, for the best effect, the slit or slits also should cover the middle of the resonator. Typically, it is be desired to achieve as high a quality factor as possible. This generally will be achieved by having as much of the electric field of the mode of interest pass through the slit or slits as possible. Therefore, it is envisioned that, in most designs, a full slit through the resonator (i.e., such that the resonator is physically separated into distinct pieces) will be most desirable. Such a design also will generally simplify the fabrication of the resonator. Particularly, a conventional resonator puck simply could be cut into slices to fabricate a resonator in accordance with the present invention.

On the other hand, it may be desired to incorporate blind slits rather than full slits for ease of handling, among other things. Particularly, it may be highly desirable for purposes of ease of handling and assembly of a circuit to keep the resonator as one unitary piece. More particularly, a unitary resonator with blind slits in one direction (radial or vertical) will be easier to handle and would guarantee that the width of the slit is exactly as desired without the need for precise assembly procedures.

Dielectric resonators with slits in accordance with the present invention may be manufactured by any number of techniques. For instance, as already noted, conventional resonators may be cut or sliced. Alternately, a resonator may be fabricated as discrete pieces which are later assembled into a single resonator. Slits also may be machined into the surfaces of the resonators, such as by milling or other machining operations. Even further, resonators may be cast with the slits formed in them.

Generally, it is advisable to position the slits perpendicular to the lines of the electric field of the mode of interest. However, again, this is not a necessity. The concept of the invention will work as long as the lines of the electric field of the mode of interest pass through the dielectric-to-air and air-to-dielectric interfaces defined by the slit.

The slit generally will have no effect on field lines that are parallel to the slit because such lines will not cut through a dielectric-to-air or air-to-dielectric interface. Of course, if the slit does not run the full length of the resonator from the top surface 32*c* to the bottom surface 32*d*, then, the $H_{11}$ field lines that pass through the slits 34 would, in fact, pass through a dielectric-to-air and/or air-to-dielectric interface. However, even in such embodiments with vertically blind or double blind slits, as long as the slits are narrow in the phi dimension (i.e., width, w), the portions of the field that pass through the slits parallel thereto would be so small compared to the overall field that it would have very little effect on that field. In fact, Maxwell's equations show that any field lines that do pass through a dielectric-to-air or air-to-dielectric interfaces in the tangential plane (i.e., in the plane of the slit) do not change the mode in any event.

Generally, as the number of slits increases, the Q as well as the frequency increase. This is a simple result of the fact that, as the number of slits increases, more of the field will be in air.

Normally, it is desirable to maximize the uniformity of the fields. Accordingly, in order to achieve this goal, the slits should be uniformly spaced. For instance, if there are four slits, they should be spaced at 90° intervals around the resonator, as shown in FIG. 3A. However, this is not a necessary aspect of the invention.

Furthermore, the slits generally should be of uniform width in the phi direction regardless of radial distance from the longitudinal axis of the resonator. While not a limitation of the invention, for any given application, there will be a particular width of the slit that achieves the desired goal of increasing Q without experiencing a significant amount of field decay in the slit. Generally, this width will be the desired width for the entire slit. Again, however, this is not a requirement of the invention.

The slits need not be perfectly uniform in the sense that the surfaces of the resonator body that define the slits need not be highly polished. More particularly, the surfaces may be relatively rough as long as the average width of the slit is in the desired range. Considering the miniscule dimensions under consideration, the cost of finely machining the surfaces to assure a 2–20 mil slit, let alone a 100–1000 atom wide slit, could be significant. This type of precision is not necessary as long as the variations in the gap (slit width) are on the microscopic scale and as long as the average gap over the entire slit is generally in the desired range. The two surfaces of the dielectric resonator that define the slit, e.g., surfaces 32*e* and 32*f* in FIG. 3D, may actually be placed in touching relationship such that the two surfaces are in contact at their high points, but there are gaps in between the contact points.

In embodiments of the invention in which the resonator body is comprised of distinct pieces (e.g., the slits run completely through the resonator body) the individual pieces (or slices) of the resonator body may be mounted within the enclosure such that they are movable relative to each other. Specifically, they may be mounted so that they are movable in the radial direction so as to alter the effective widths of the slits. (This will also alter the size of the central longitudinal through hole, if one is provided). Thus, movement of the individual slices of the resonator body can be used as an effective tool for tuning the resonator.

Figure 4:
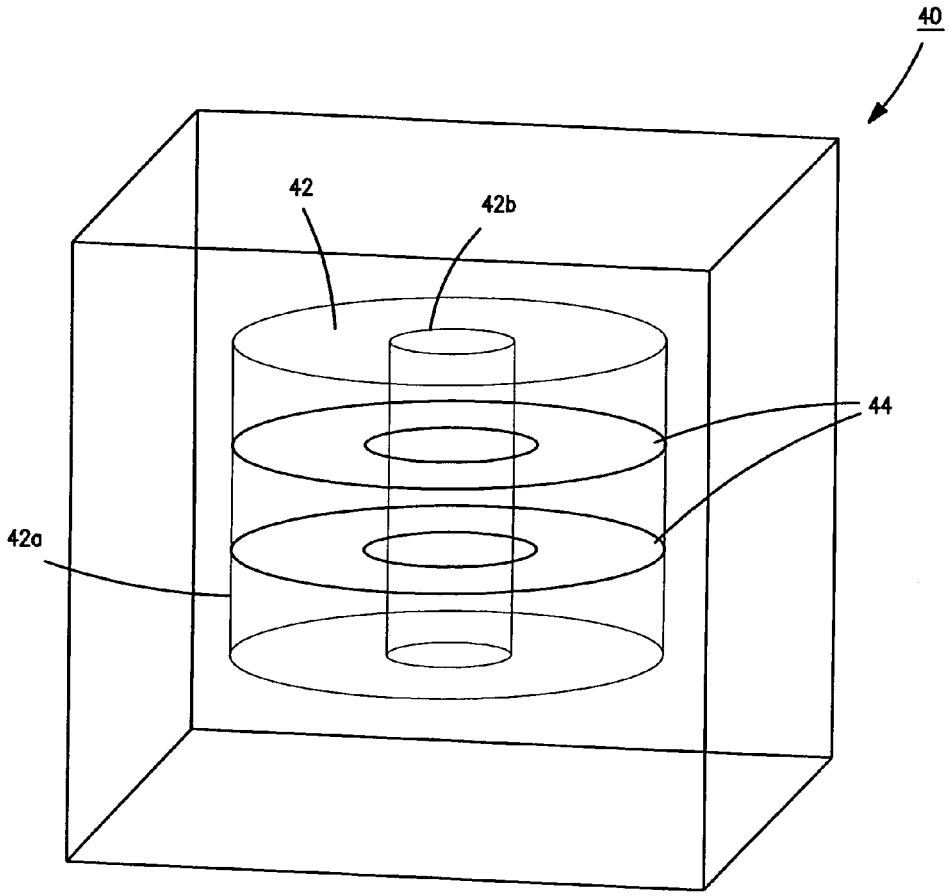
FIG. 4 is a transparent isometric view of a cylindrical resonator having horizontal, radial, blind slits in accordance with another embodiment of the present invention.

FIG. 4 illustrates an embodiment of the invention adapted to increase the Q factor with respect to resonators and resonator circuits in which the fundamental mode is an electric type mode (i.e., having its electric field lines oriented vertically), rather than a magnetic type mode. For instance, there are circuits, and particularly, dual mode circuits, that utilize the $H_{11}$ mode rather than the TE mode as the fundamental mode because the $H_{11}$ mode has two orthogonally polarized fields and, thus, can be used to create a dual mode circuit, as known the related arts. All of the concepts discussed above in connection with vertical slits relative to magnetic type modes basically apply equally to horizontal slits relative to electric type modes. FIG. 4 illustrates a single pole circuit 40 having one resonator 42. The horizontal slits 44 in the FIG. 4 embodiment are blind in the radial direction (in this particular example they reach to the exterior cylindrical surface 42*a*, but do not reach the interior cylindrical surface 42*b* defining the central through hole. However, this is merely exemplary. They may be may be full, blind, or double blind. They may be fabricated by cutting, milling, machining, casting, etc. Likewise, they generally should be at least about 100 to 1000 atoms in thickness.

While, we have referred to the slits as being comprised of air in the discussion herein, this is merely exemplary. The primary point is that slits are comprised of something having a lower $\in$ that the dielectric material of the resonators, and preferably is lossless. The slit normally will be filled with air. However, in certain embodiments in which the resonator is hermetically packaged in vacuum, the slit would comprise a vacuum. In other embodiments, it may be filled with liquid or a sheet material having a lower $\in$ than the dielectric resonator material.

Figure 5:
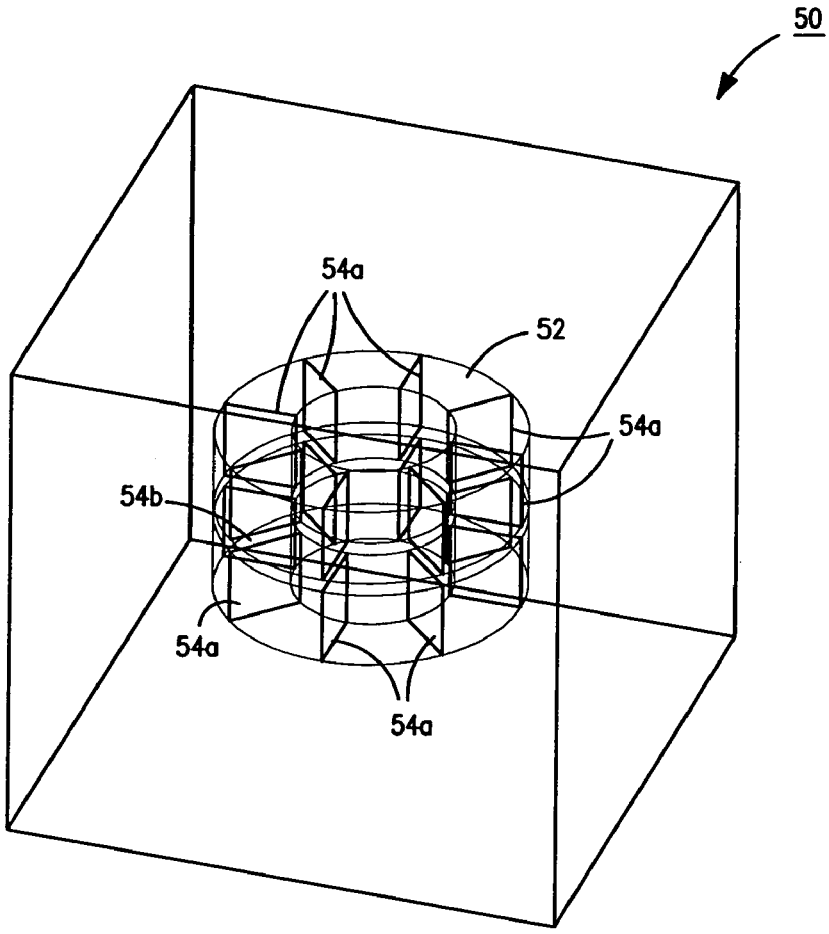
FIG. 5 is a transparent isometric view of a cylindrical resonator having vertical and horizontal, radial slits in accordance with the present invention.

If the increase in frequency resulting from the incorporation of the slits in the resonator (e.g., vertical slits added to increase the Q of the TE mode) reduces mode separation between that mode and the next mode (e.g., the $H_{11}$ mode) unacceptably, then one or more horizontal slits can be added to push the frequency of the electric-type $H_{11}$ mode up and away from the fundamental frequency of the TE mode. FIG. 5 illustrates a dielectric resonator circuit 50 incorporating this concept. Particularly, the resonator 52 has eight, uniformly-spaced, vertical slits 54*a* to increase the Q of the fundamental TE mode and one horizontal slit 54*b* for purposes of pushing the frequency of the $H_{11}$ mode upwards and away from the increased frequency of the TE mode. When the sole purpose of a slit is to affect an interference mode (such as the horizontal slit 54*b* in this embodiment, the purpose of which is to move the $H_{11}$ interference mode further up in frequency), the slit may be wider than in those cases where the purpose of the slit is to affect the mode of interest. In fact, it may be desirable to make the slit wide for the very purpose of causing the field to decay and/or disappear. Accordingly, in the circuit of FIG. 5, it would be desirable to make the horizontal slit 54*b* relatively wide, e.g., about 10 mm or more, so as to cause the $H_{11}$ mode to become very weak and/or disappear entirely.

Figure 6A:
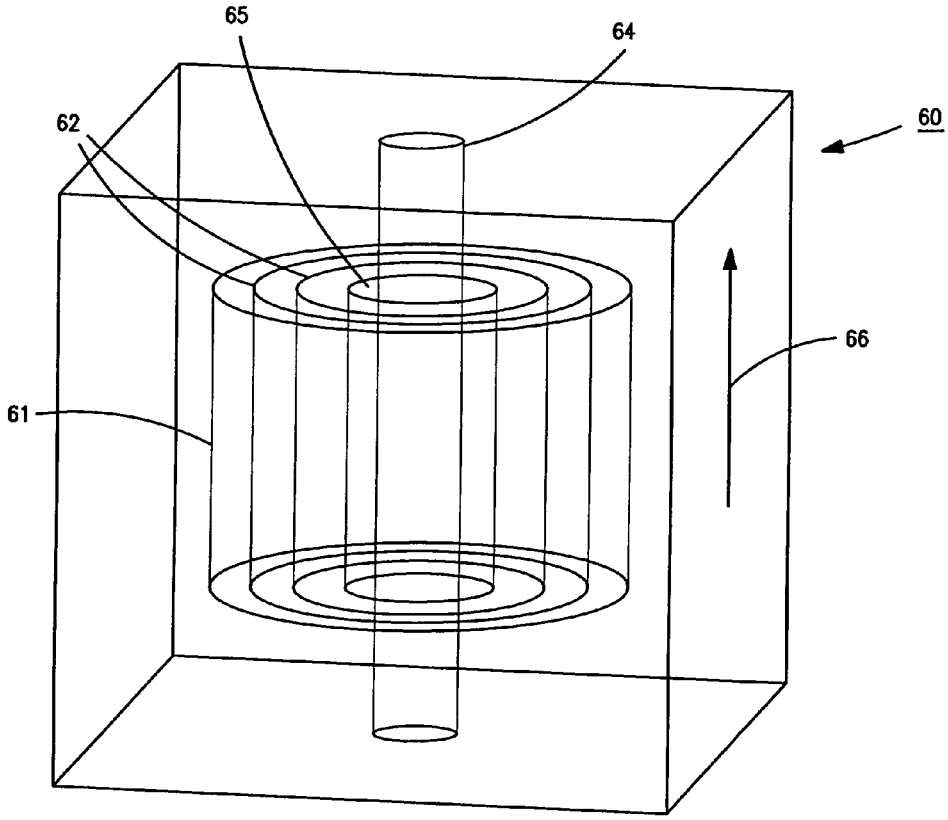
FIG. 6A is a transparent isometric view of a cylindrical resonator having annular vertical slits in accordance with the present invention.
Figure 6B:
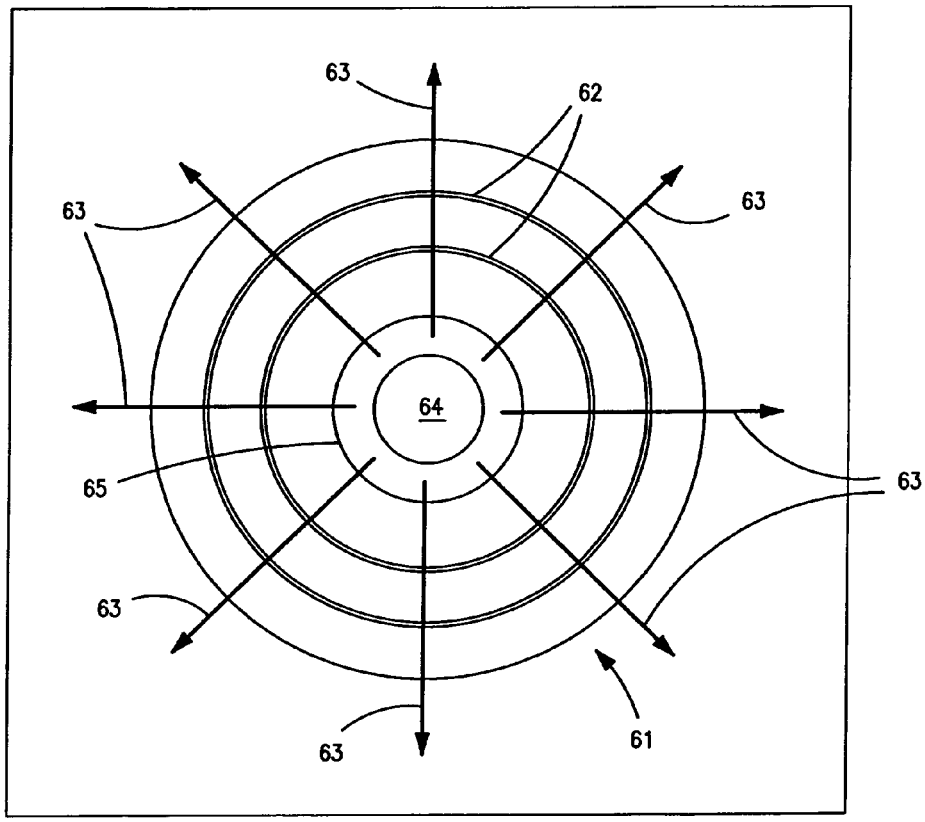
FIG. 6B is a top view of the circuit of FIG. 6A.

FIG. 6A is a perspective transparent view of a resonator circuit 60 in accordance with another embodiment of the invention. The resonator body 61 comprises a plurality of vertical annular slits 62. This embodiment is particularly suitable for use in connection with circuits in which the operational mode has electric field lines that flow radially outwardly from the resonator. Such lines would cut through the slits parallel to the width dimension of the slits, which is preferable, as previously noted. FIG. 6B is a top view of the resonator circuit 60 shown in FIG. 6A. Lines 63 represent the radially outward electric field lines of the operational mode. A significant mode that has electric field lines that flow in this direction is the transverse electromagnetic (TEM) mode.

This embodiment further includes a central coaxial metal material 64 disposed within a central longitudinal through hole 65 of the resonator body 61. The slits 62 may be air gaps or may be provided by inserting a sheet of lossless material between the different cylindrical sections of the resonator body 61. The Q of the TEM fundamental mode is enhanced and the frequency of the TEM mode is pushed up. As noted, the electric field lines of the TEM mode are radially outward, as illustrated by lines 63 in FIG. 6B. The direction of propagation of the TEM mode is vertically upward, as illustrated by arrow 66.

EXAMPLES

FIGS. 7A through 17C show the results of computer simulations designed to demonstrate the effects and benefits of the incorporation of slits into dielectric resonators circuits in accordance with the principles of the present invention.

Figures 7A, 7D:
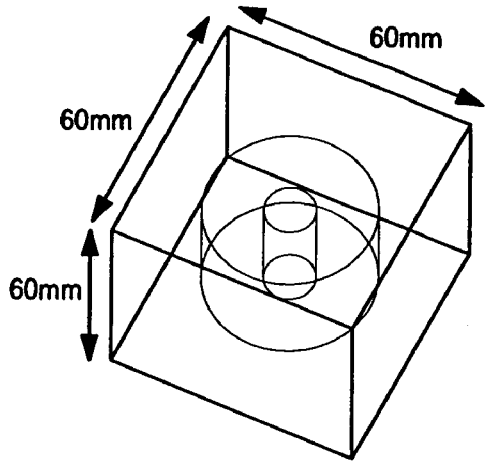
FIG. 7A is a transparent isometric view representing a conventional, cylindrical resonator circuit design with a resonator having an ∈ of 45.
FIG. 7D is table showing the frequencies of the five lowest frequency modes of the resonator circuit design of FIG. 7A.

FIG. 7A is a transparent isometric view of a conventional, single-pole dielectric resonator circuit model with the given dimensions and wherein the dielectric resonator is formed of a material having an $\in$ of 45. Computer simulations were run on this model. The fundamental mode in this simulation was the TE mode at 1.149 GHz. This circuit had a Q of 36,000 for the fundamental mode.

The loss tangent was 0.000027 and its inverse (which gives another definition for Q) was, as expected, 37,000. This demonstrates that the losses in the circuit are dielectric losses. The next lowest mode was the first hybrid mode, $H_{11}$. It has two polarizations with two slightly different corresponding frequencies. The next lowest mode was the TM mode.

Figure 7B:
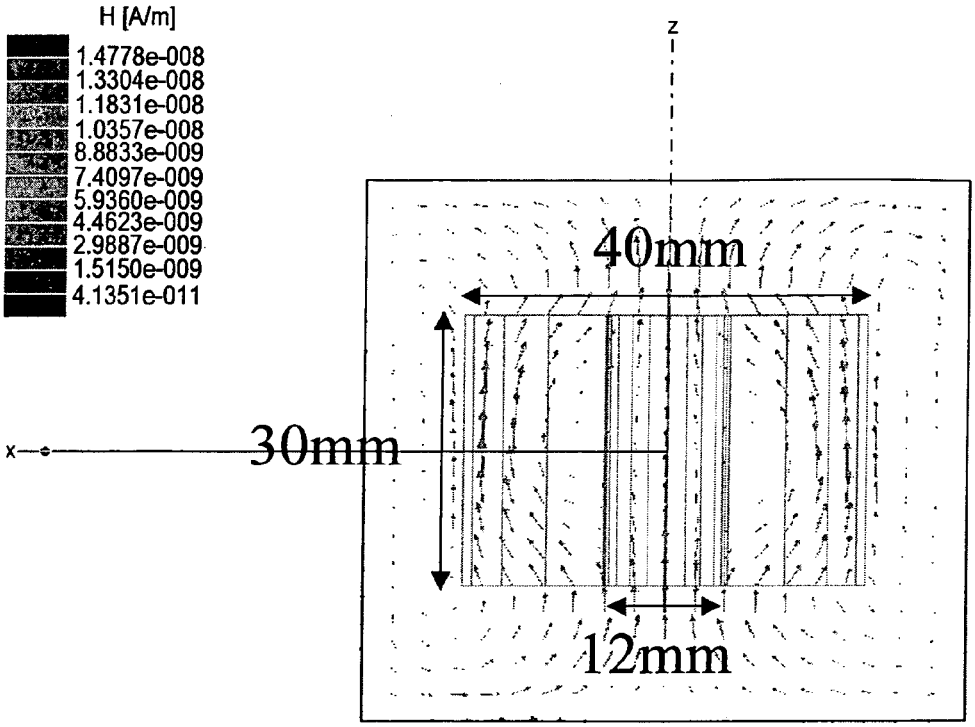
FIG. 7B is cross-sectional elevation view of the resonator circuit design of FIG. 7A showing the lines of the magnetic field of the TE mode according to experimental simulations.
Figure 7C:
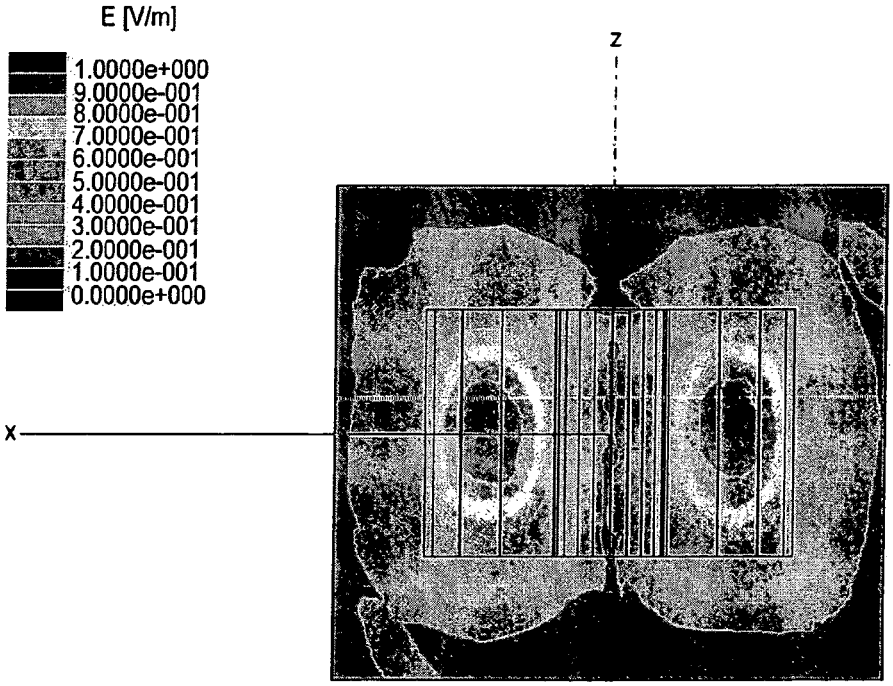
FIG. 7C is cross-sectional elevation view of the resonator circuit design of FIG. 7A showing the field strength of the electric field of the TE mode according to experimental simulations.
Figure 7E:
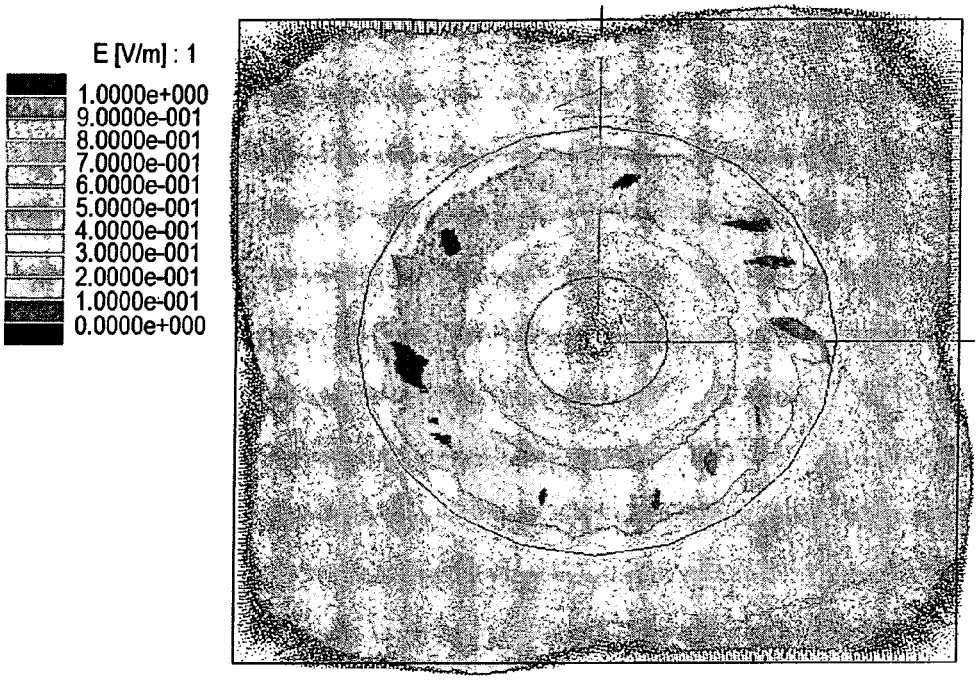
FIG. 7E is cross-sectional equatorial plan view of the resonator circuit design of FIG. 7A showing the lines of the electric field of the TE mode according to experimental simulations.
Figure 7F:
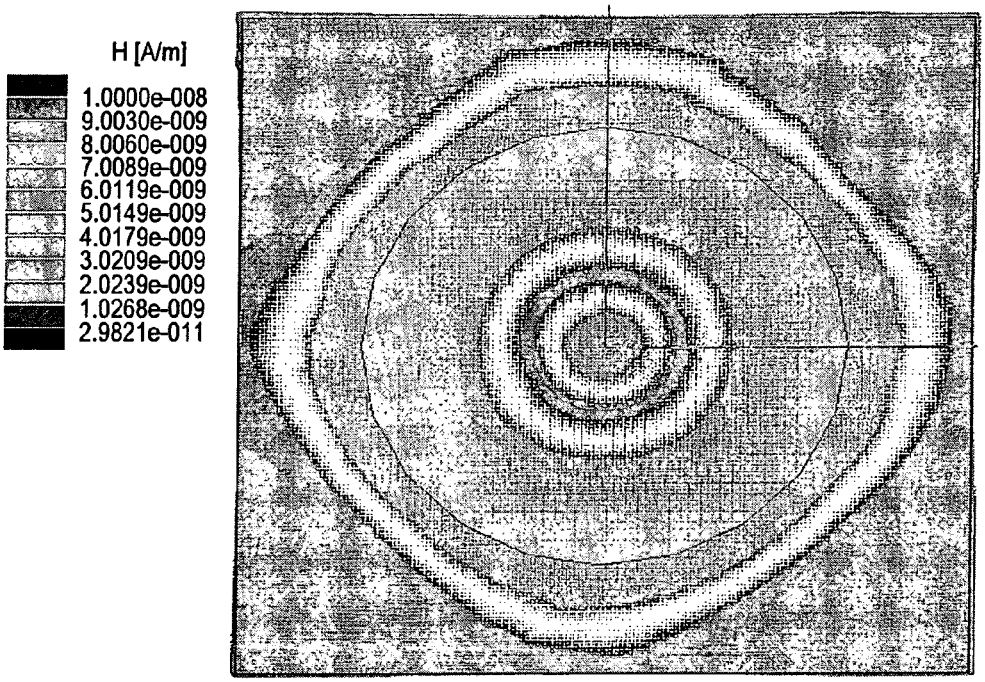
FIG. 7F is cross-sectional equatorial plan view of the resonator circuit design of FIG. 7A showing the field strength of the magnetic field of the TE mode according to experimental simulations.

FIG. 7B is a cross-sectional elevation view of the circuit showing the field lines of the magnetic field of the fundamental TE mode. FIG. 7C is another cross-sectional elevation view of the circuit showing the field strength of the electric field of the TE mode. FIGS. 7E and 7F are, respectively, equatorial plan views of the field strength of the electric field and the magnetic field, respectively. FIG. 7D is a table showing the frequencies of the five lowest modes in this conventional resonator circuit.

Figures 8A, 8D:
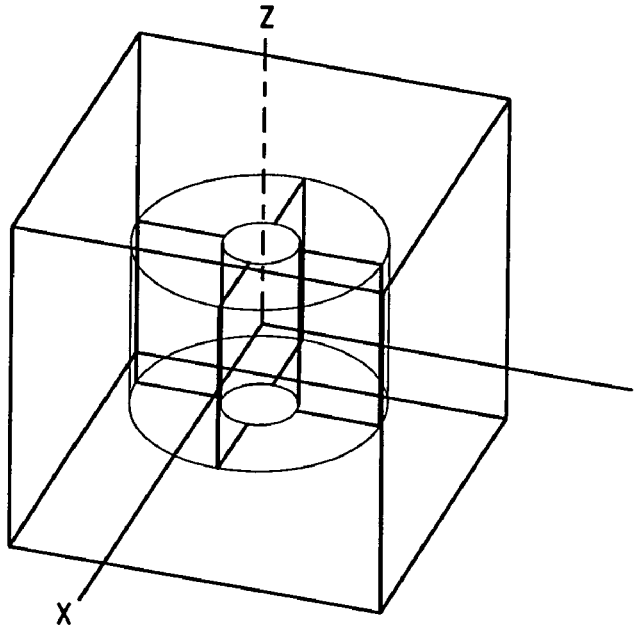
FIGS. 8A–8F are figures corresponding in content to FIGS. 7A–7F, but pertaining to a dielectric resonator circuit design identical to the dielectric resonator circuit design of FIG. 7A, except for the addition of four, equally-spaced, vertical, radial, through slits of 0.1 mm width.
Figure 8B:
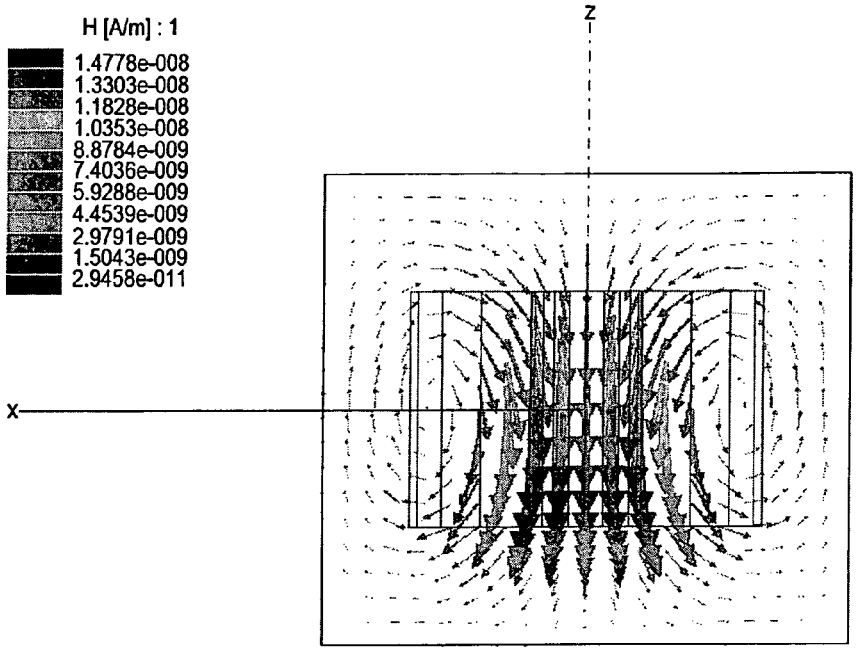
Figure 8C:
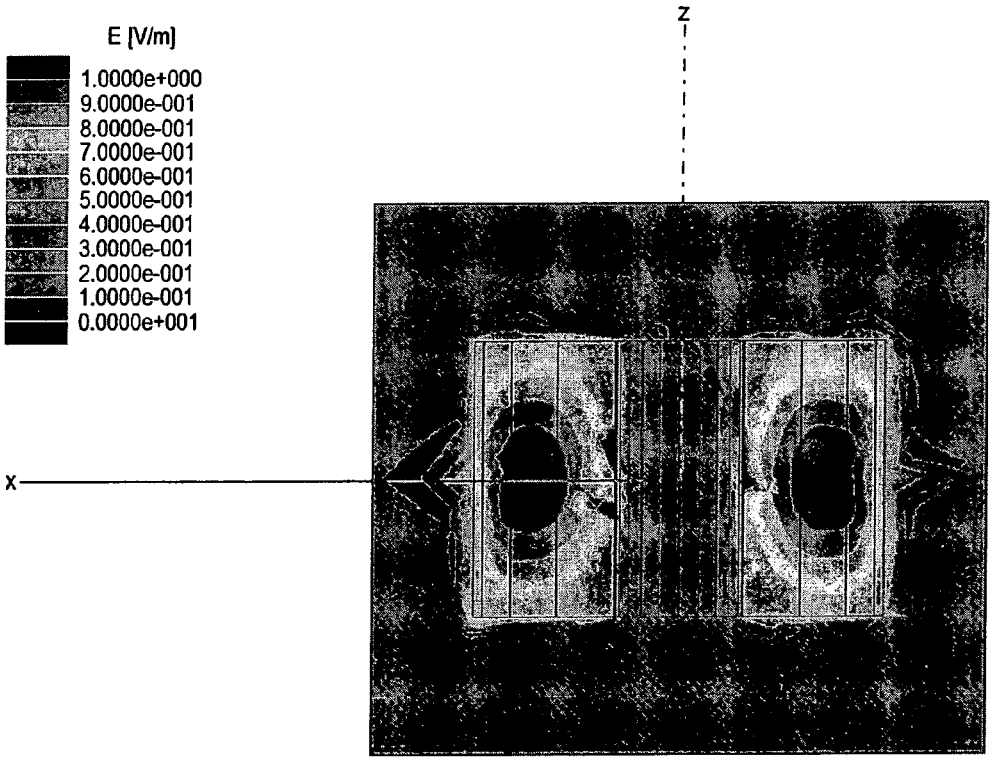
Figure 8E:
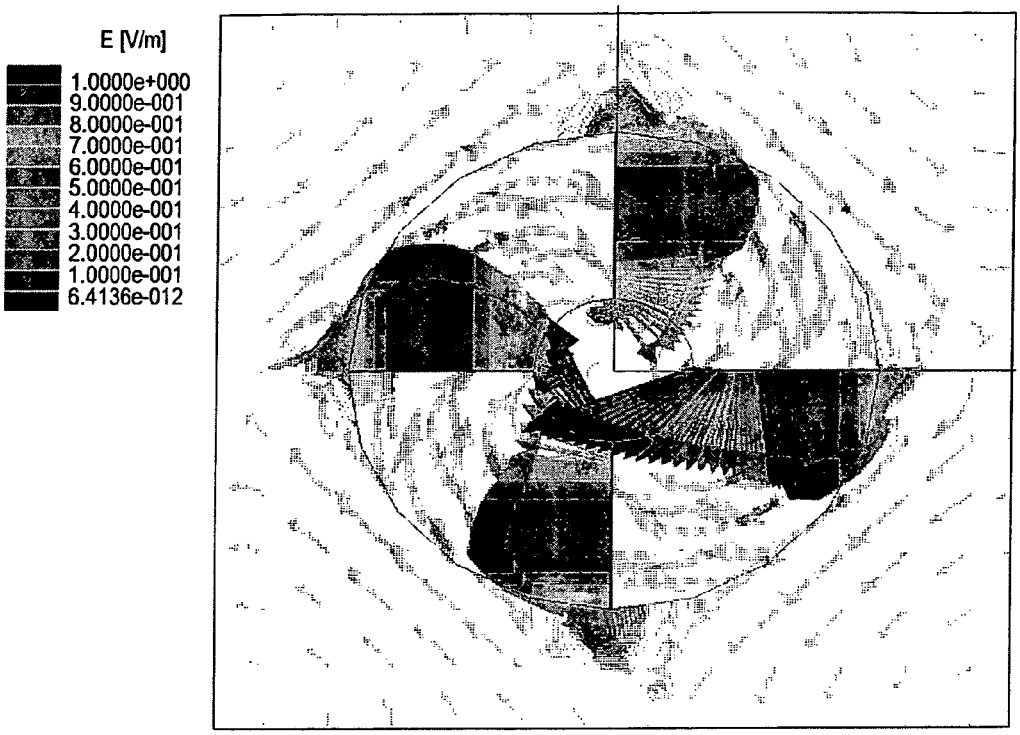
Figure 8F:
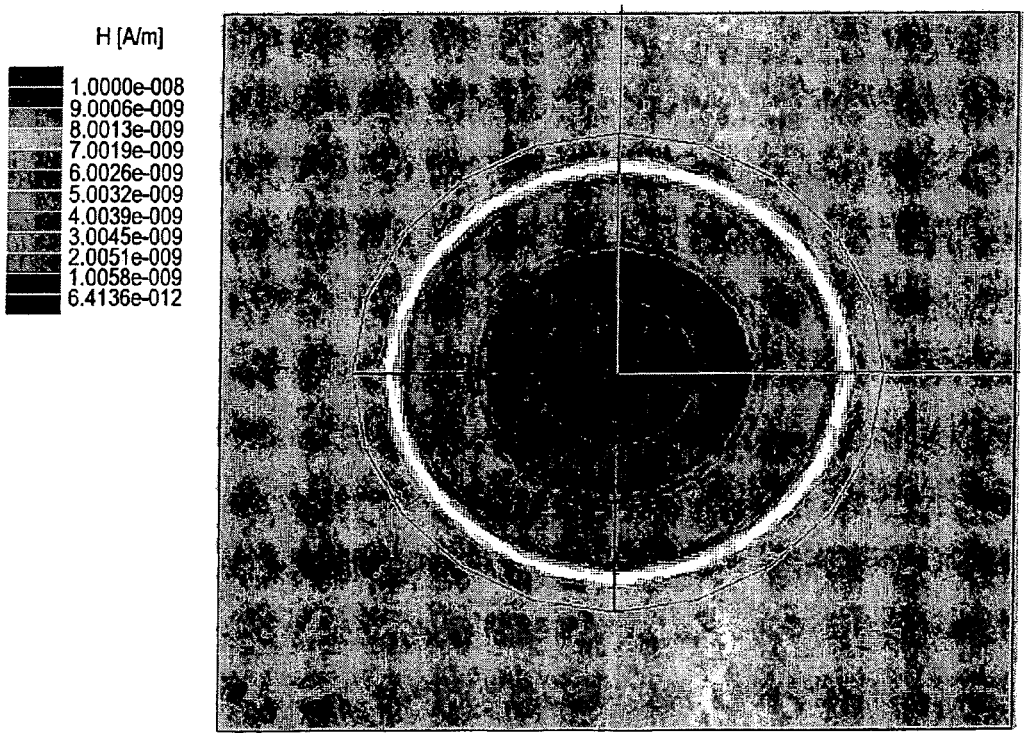

FIGS. 8A–8F illustrate the same information as FIGS. 7A–7F, but for a circuit identical to the circuit in FIG. 7A, except for the addition of four, evenly-spaced, vertical, radial, full slits of 0.1 millimeters width. As can be seen from the figures, the frequency and the Q of the TE mode move up from 1.149 GHz to 1.250 GHz and from 36,000 to 42,000, respectively. The simulations demonstrate that the Q is better than the inverse of the resonator loss tangent. Also, a comparison of FIG. 7F with FIG. 8F shows that the magnetic field is better concentrated at the center of the resonator than in the conventional circuit. A comparison of FIGS. 7E with 8E further shows that the electric field is more highly concentrated near the slot than in the conventional resonator circuit. It is conserved there without losses. This is the reason why the Q increases.

Figures 9A, 9D:
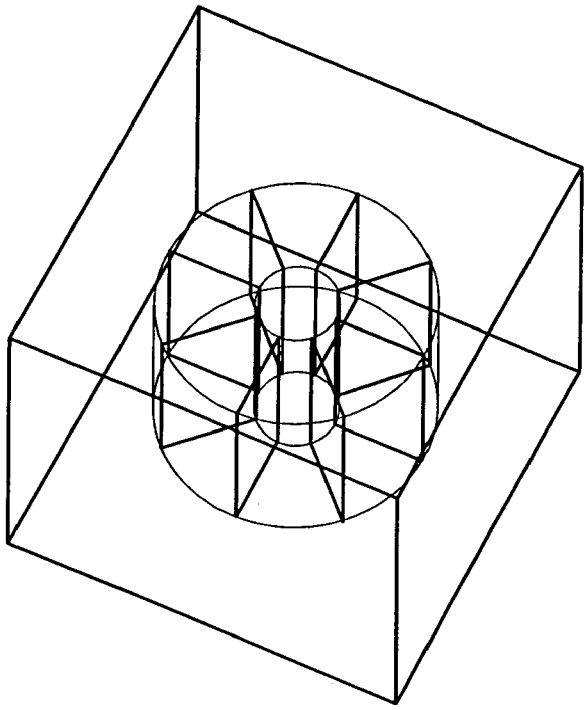
FIGS. 9A–9F are figures corresponding in content to FIGS. 7A–7F, but pertaining to a dielectric resonator circuit design identical to the dielectric resonator circuit design of FIG. 7A, except for the addition of eight, equally-spaced, vertical, radial, through slits of 0.1 mm width.
Figure 9B:
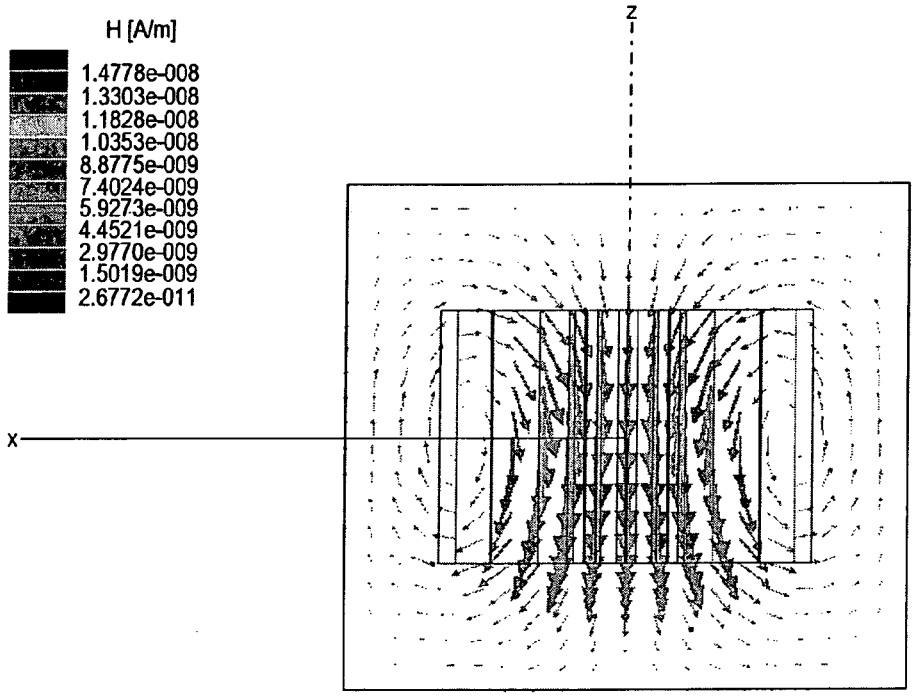
Figure 9C:
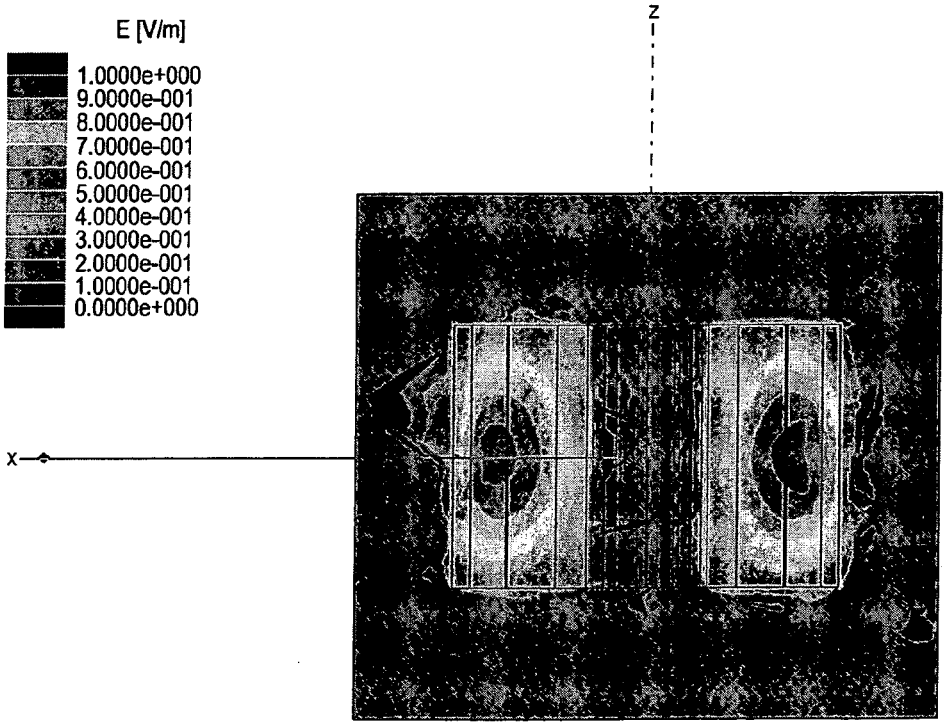
Figure 9E:
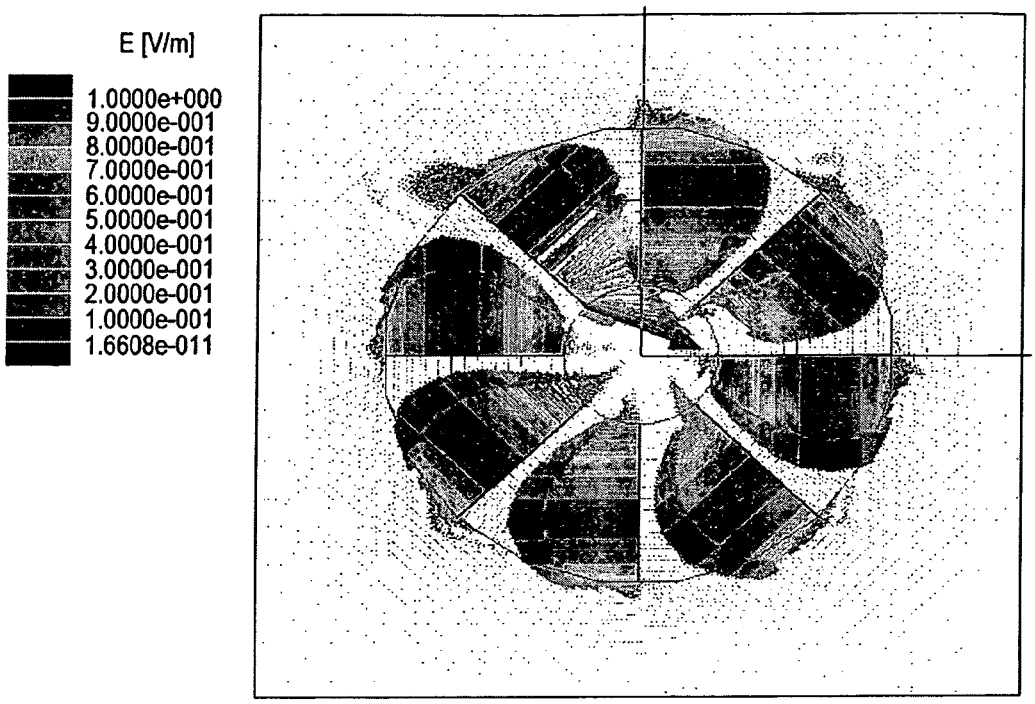
Figure 9F:
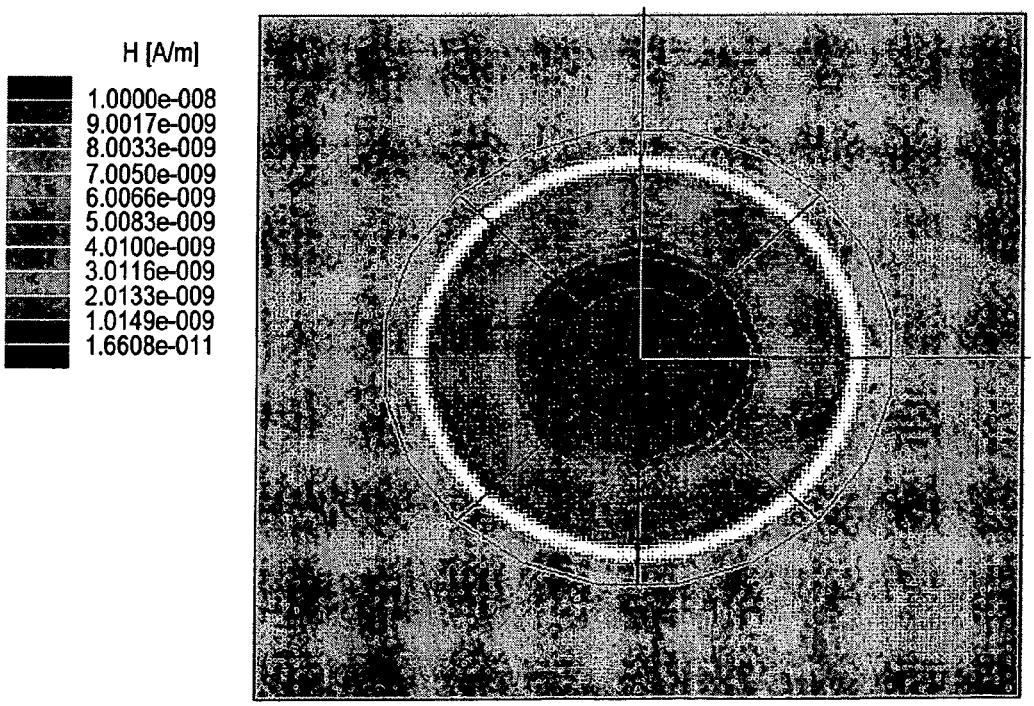
Figures 10A, 10B:
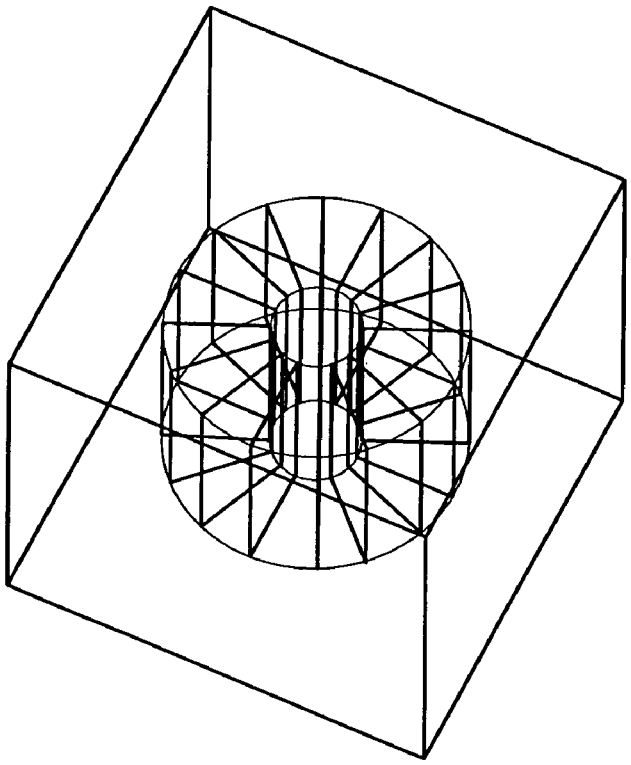
FIGS. 10A–10F are figures corresponding in content to FIGS. 7A–7F, but pertaining to a dielectric resonator circuit design identical to the dielectric resonator circuit design of FIG. 7A, except for the addition of sixteen, equally-spaced, vertical, radial, through slits of 0.1 mm width.
Figure 10C:
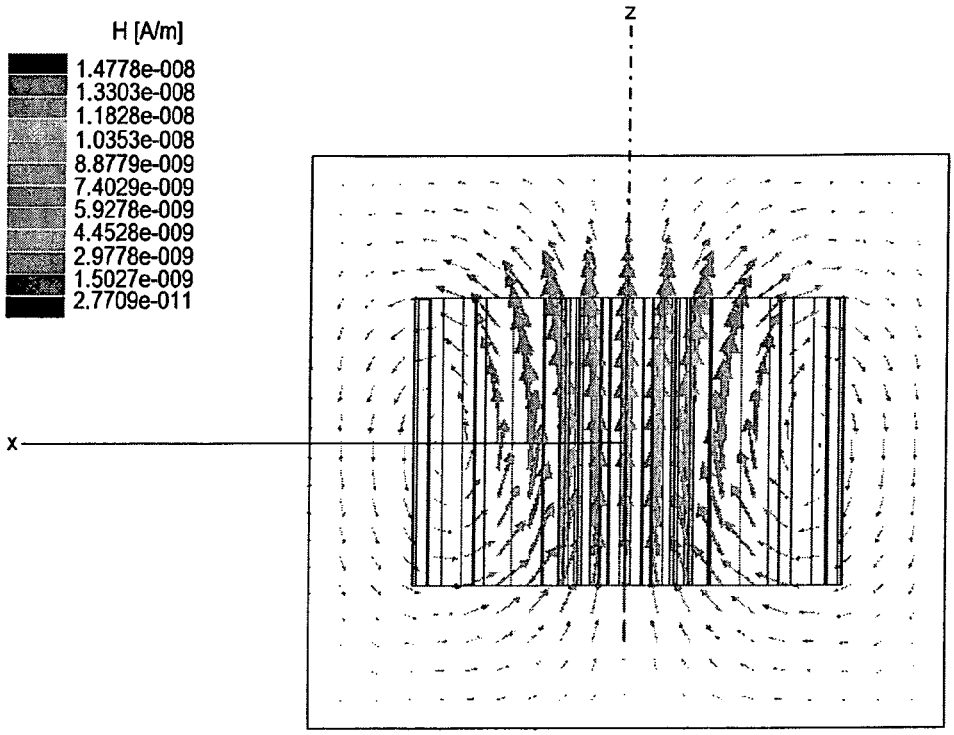
Figure 10D:
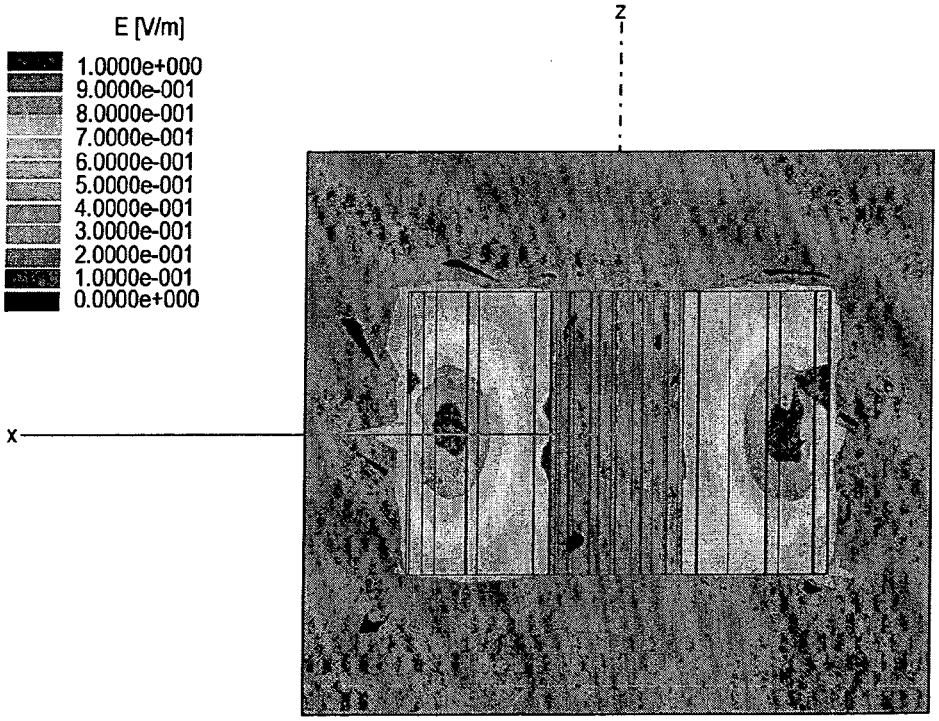
Figure 10E:
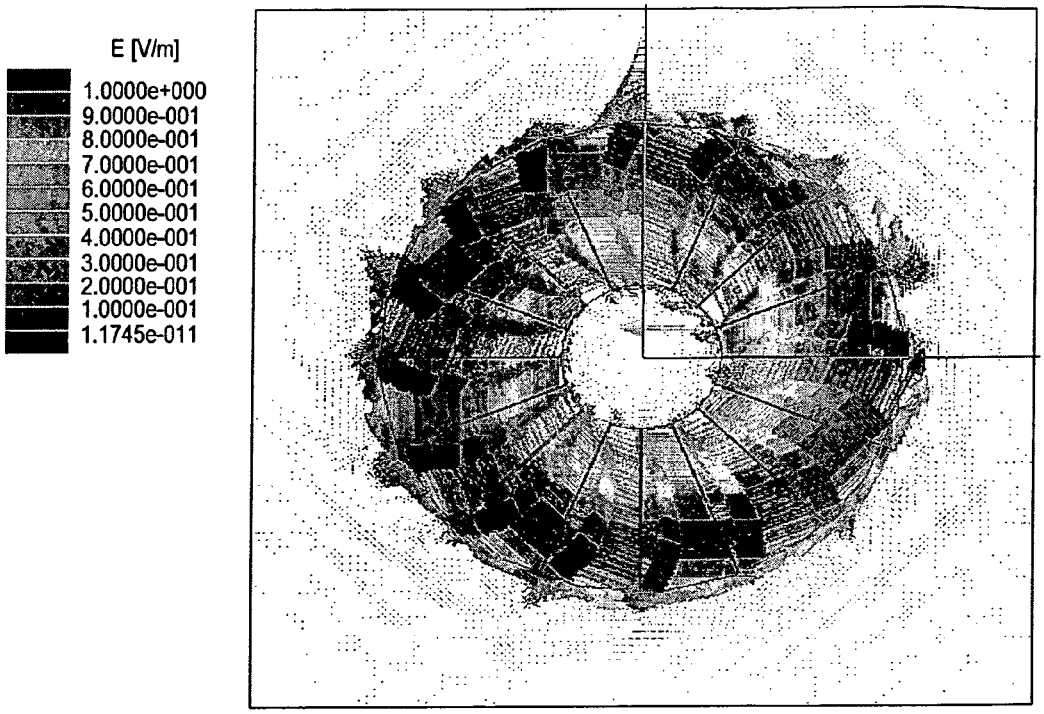
Figure 10F:
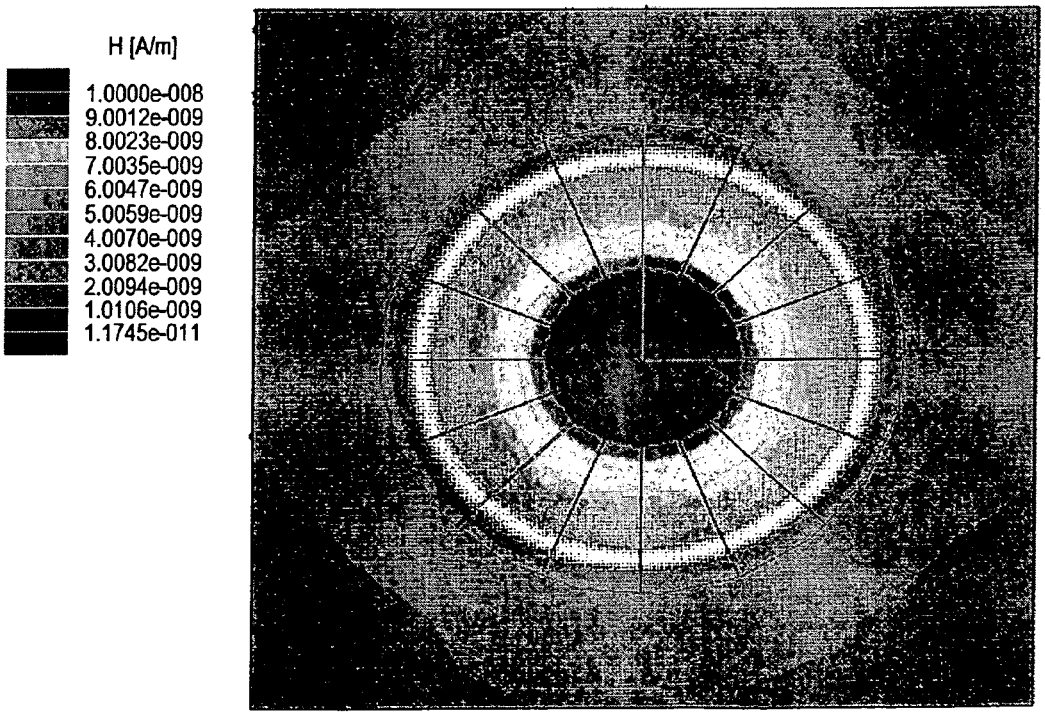

Referring now to FIGS. 9A through 9F, these figures show the experimental results for a circuit identical to the circuits of FIGS. 7 and 8, except having eight slots of 0.1 millimeter width. Note that the frequency and Q move up even further to 1.31 GHz and 49,000 respectively. The increase compared to the conventional resonator circuit of FIG. 7 is 16% for the frequency and 36% for Q. As seen in FIG. 9D, the TE mode is still the fundamental mode, but its separation from the next mode, the $H_{11}$ mode, has become much smaller than in the conventional circuit. Furthermore, note from FIGS. 9B, 9C, 9E, and 9F that both the electric and magnetic field concentrations are further improved and that the magnetic dipole has become even more efficient. The electric field energy is more uniformly distributed in the resonator area (always concentrated at the slots) and the magnetic field is more concentrated at the center.

FIGS. 10A through 10F show the experimental results for simulations run on a dielectric resonator circuit similar to the circuit of FIGS. 7, 8, and 9, except having 16 evenly spaced slots of 0.1 millimeter width. The TE mode frequency and Q are now 1.506 GHz and 62,000, respectively. Thus, compared to the conventional circuit of FIG. 7, the frequency has increased by 31% and the Q by 72%.

Based on the trend, it seems that, if the number of slots is doubled again to 32, the frequency will be increased approximately 50% relative to the conventional resonator circuit and the Q will be more than doubled.

Figures 11A, 11D:
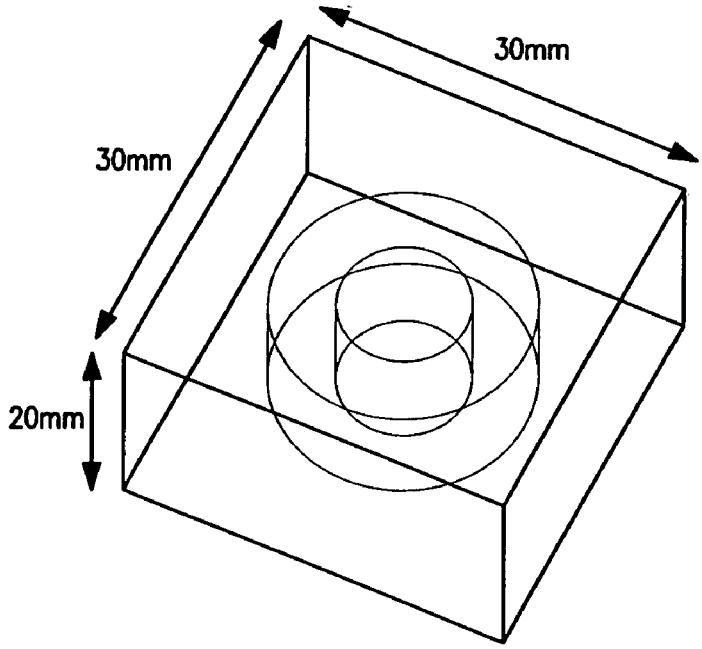
FIG. 11A is a transparent isometric view representing a conventional, cylindrical resonator circuit design with a resonator having an ∈ of 78.
FIG. 11D is table showing the frequencies of the two lowest frequency modes of the resonator circuit design of FIG. 11A.
Figure 11B:
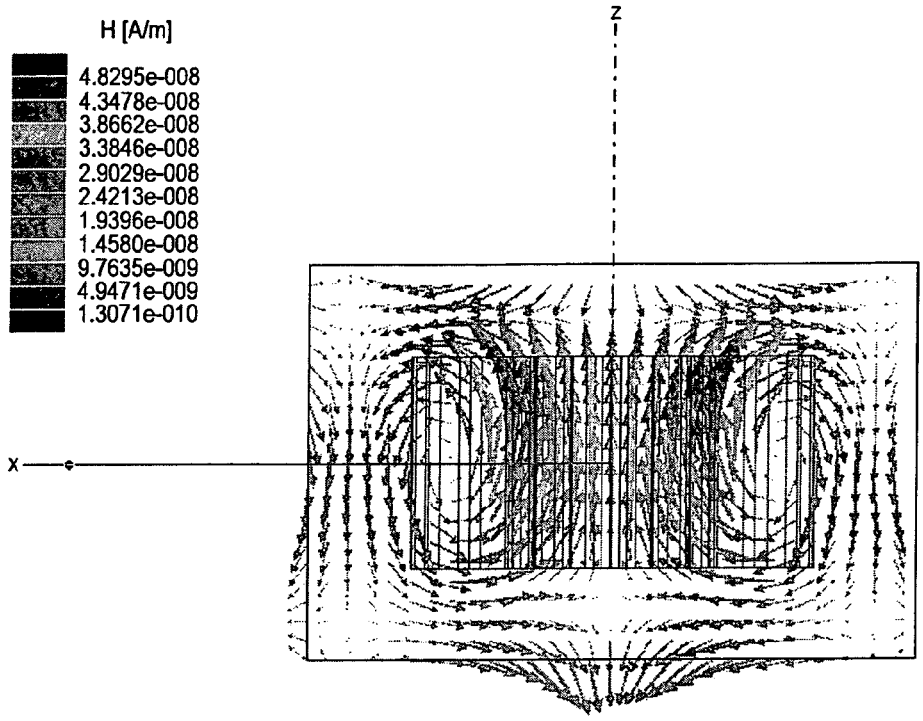
FIG. 11B is cross-sectional elevation view of the resonator circuit design of FIG. 11A showing the lines of the magnetic field of the TE mode according to experimental simulations.
Figure 11C:
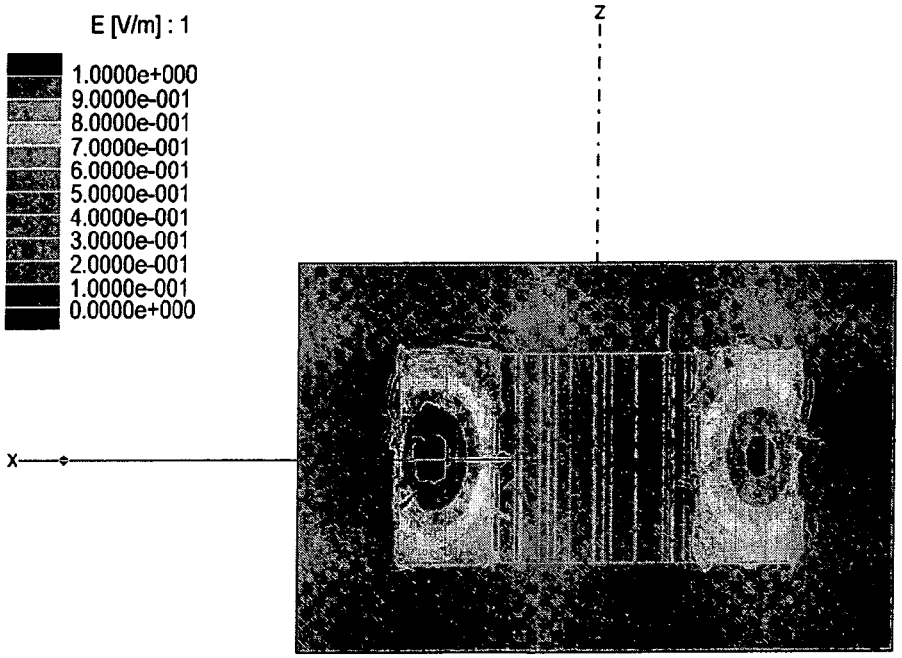
FIG. 11C is cross-sectional elevation view of the resonator circuit design of FIG. 11A showing the field strength of the electric field of the TE mode according to experimental simulations.
Figures 12A, 12D:
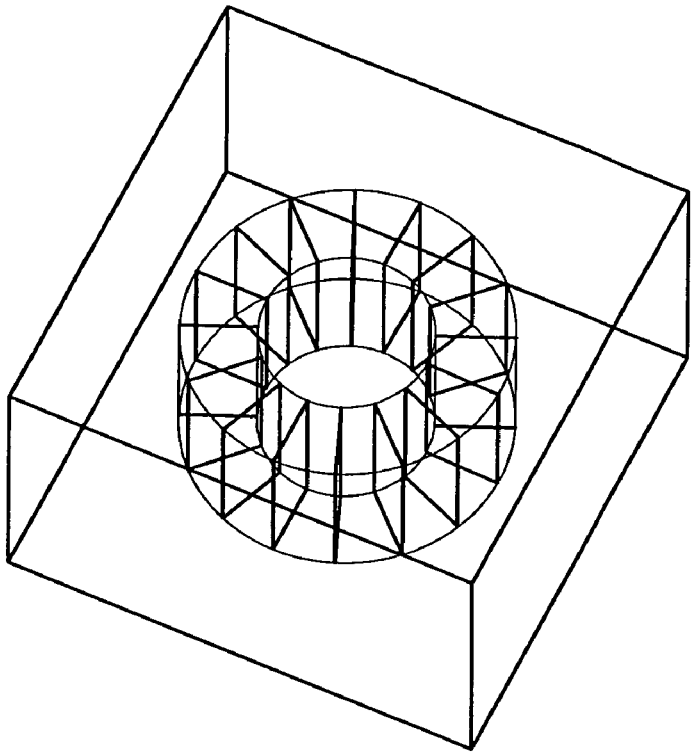
FIGS. 12A–12D are figures corresponding in content to FIGS. 11A–11D, but pertaining to a dielectric resonator circuit design identical to the dielectric resonator circuit design of FIG. 11A, except for the addition of sixteen equally spaced, vertical, radial, through slits of 0.05 mm width.
Figure 12B:
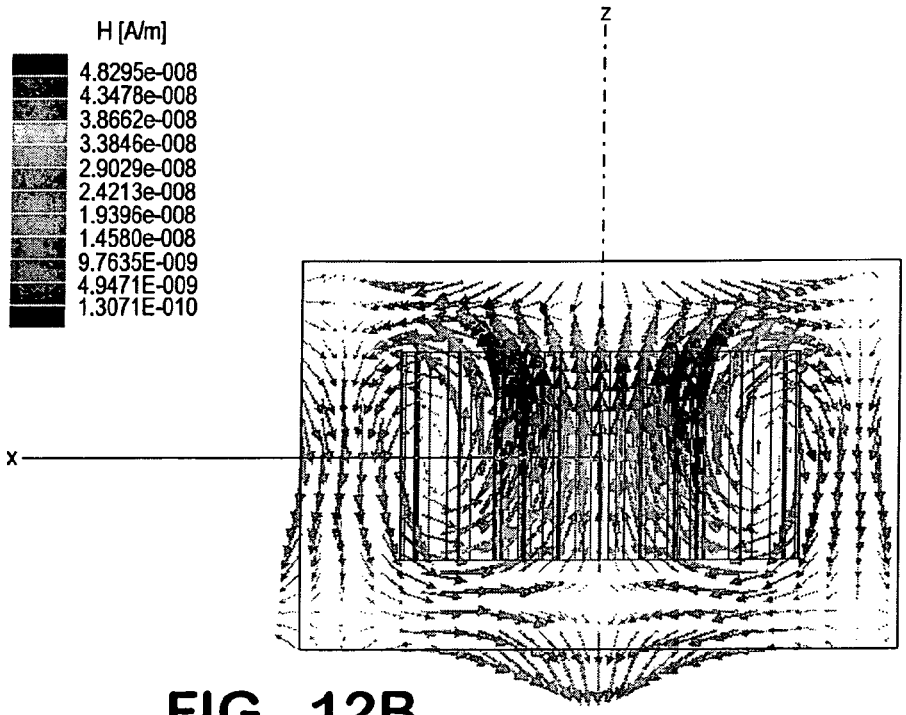
Figure 12C:
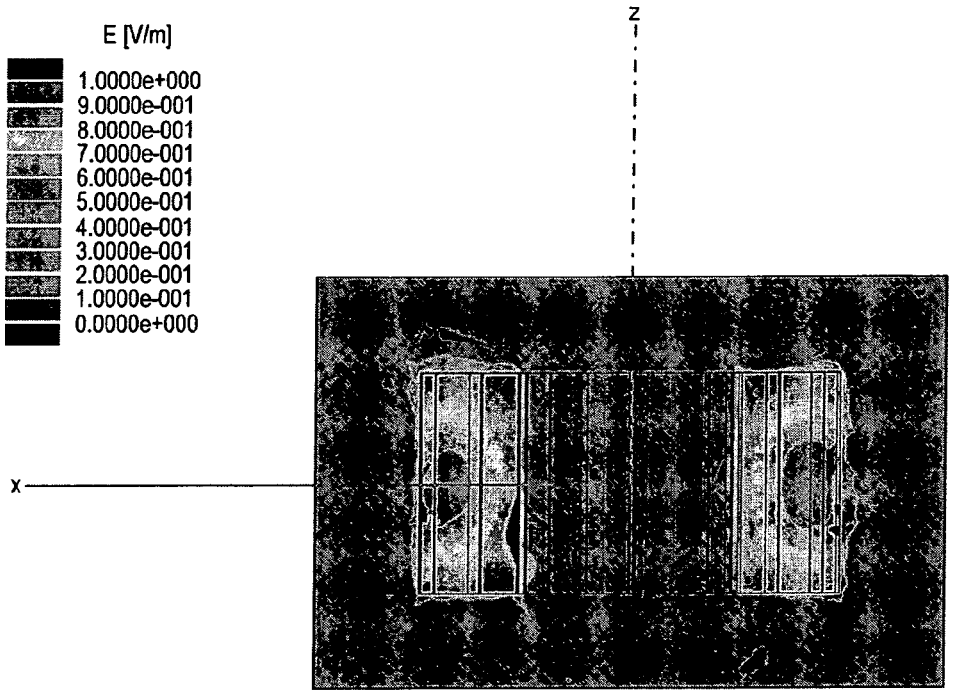
Figures 13A, 13D:
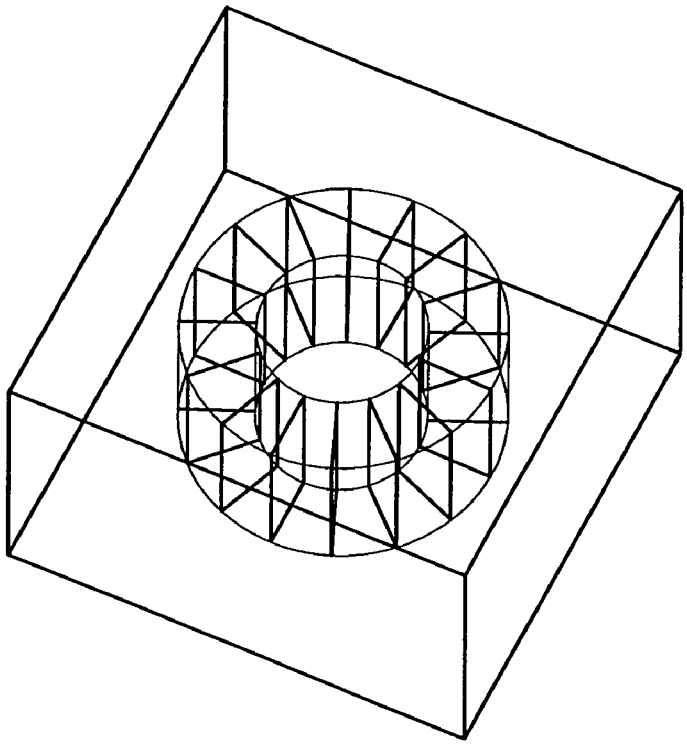
FIGS. 13A–13D are figures corresponding in content to FIGS. 11A–11D, but pertaining to a dielectric resonator circuit design identical to the dielectric resonator circuit design of FIG. 11A, except for the addition of sixteen, equally spaced, vertical, radial, through slits of 0.1 mm width.
Figure 13B:
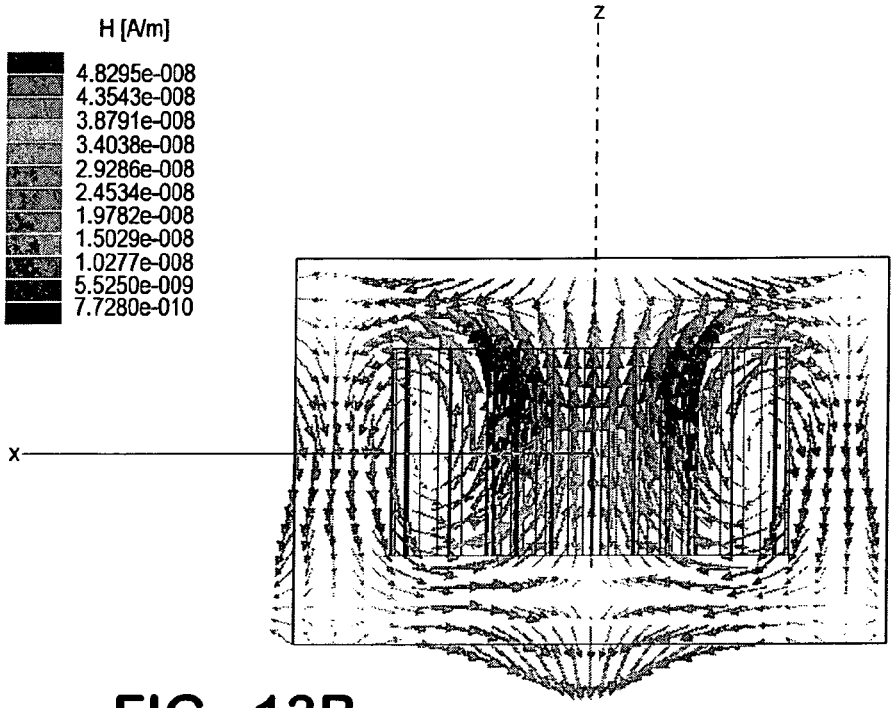
Figure 13C:
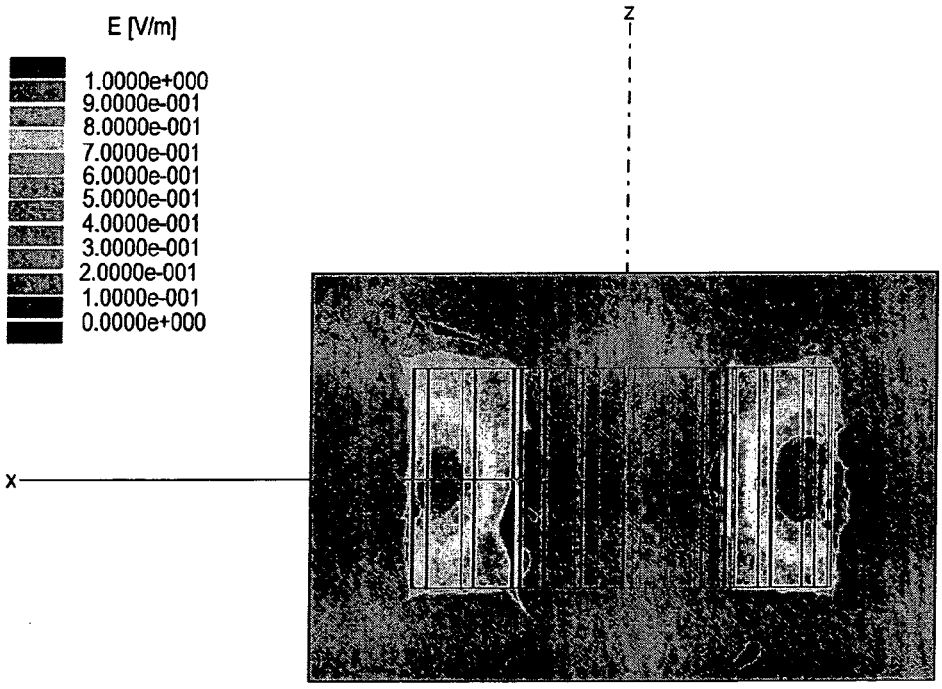

FIGS. 11A through 11D demonstrate results of experimental simulations in connection with a conventional resonator having an $\in$ of 78 and a center frequency for the fundamental TE mode of about 2 GHz. The Q at 2.066 GHz is 4,300. The loss tangent is 1/5000. A transparent isometric view of the circuit is shown in FIG. 11A, a cross sectional side elevation view showing the magnetic field lines is shown in FIG. 11B, a cross sectional elevation view showing the electric field strength is shown in FIG. 11C, and the frequencies of the two lowest modes are shown in FIG. 11D.

FIGS. 12A–12D show the corresponding experimental results as FIGS. 11A–11D for a resonator circuit similar to that of FIGS. 11A–11D except for the addition of 16 slots of 0.05 millimeters. The Q is almost doubled to 8,150 and the center frequency is increased by approximately 50% to 3.005 GHz compared to the conventional circuit of FIGS. 11A–11D. The loss tangent is still 1/5000.

FIGS. 13A–13D show the corresponding experimental results as FIGS. 12A–12D for a resonator circuit similar to that of FIGS. 12A–12D except that the gaps are now doubled in width to 0.1 millimeters. As shown, the Q has further increased to 10,300 and the frequency of the fundamental TE mode has increased to 3.600 GHz.

It should be noted that, in the last example (FIGS. 13A–13D), the frequency of the fundamental TE mode has moved very close to the frequency of the next lowest mode, the $H_{11}$ mode. Particularly, the TE mode is at 3.600 GHz while the $H_{11}$ mode is at 3.774 GHz. The frequencies of the two modes are too close to accurately and easily distinguish between them. This problem can be solved by adding one or more horizontal slits to the resonator in order to cut the electric field of the $H_{11}$ mode and cause it to move higher and away from the frequency of the TE mode.

Figures 14A, 14D:
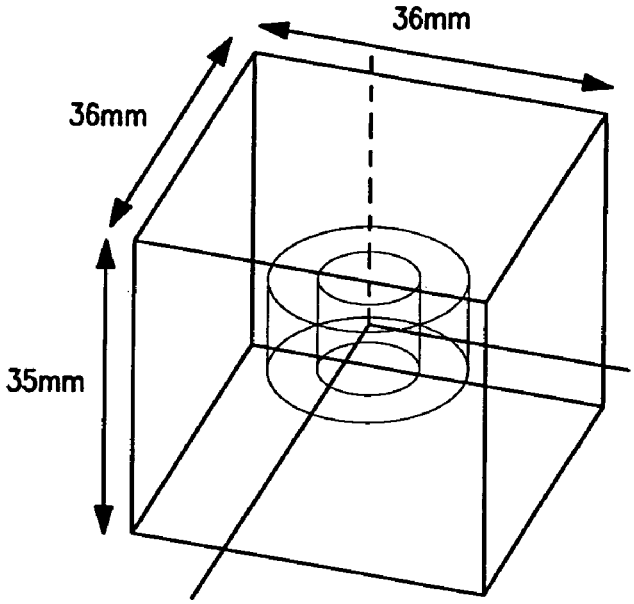
FIG. 14A is a transparent isometric view representing a conventional, cylindrical resonator circuit design identical to the circuit design of FIG. 11A, except having a larger housing.
FIG. 14D is table showing the frequencies of the two lowest frequency modes of the resonator circuit design of FIG. 14A.
Figure 14B:
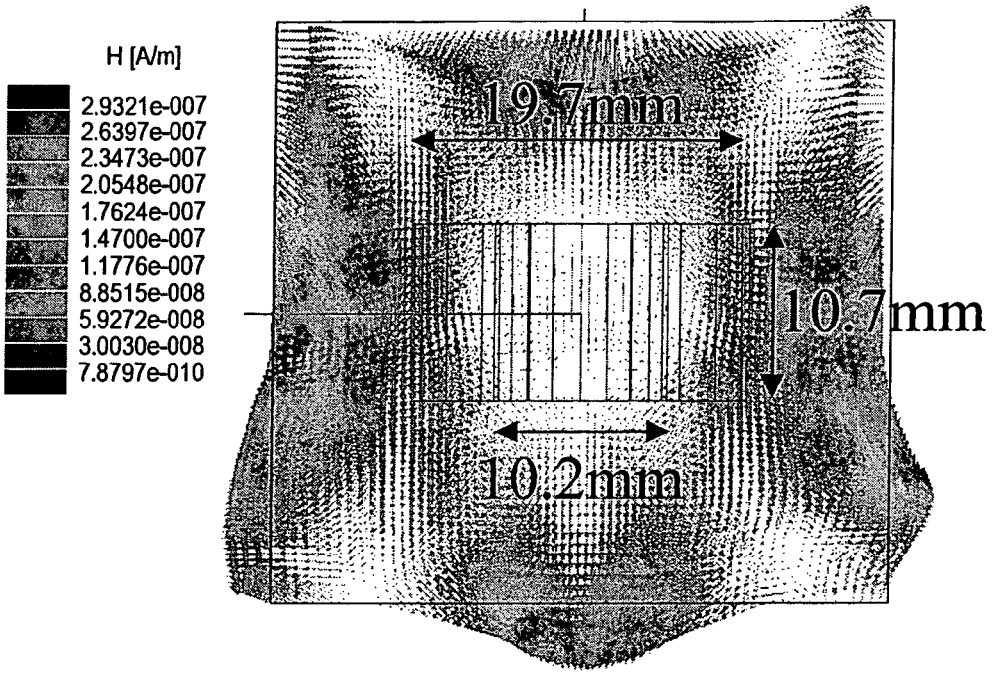
FIG. 14B is a cross-sectional elevation view of the resonator circuit design of FIG. 14A showing the lines of the magnetic field of the TE mode according to experimental simulations.
Figure 14C:
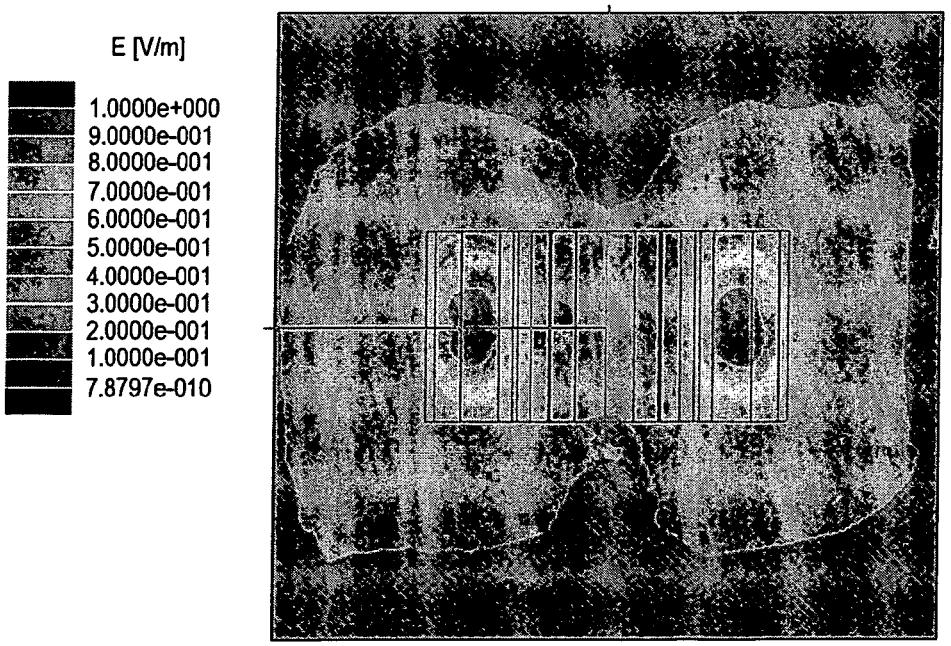
FIG. 14C is cross-sectional elevation view of the resonator circuit design of FIG. 14A showing the field strength of the electric field of the TE mode according to experimental simulations.
Figures 15A, 15D:
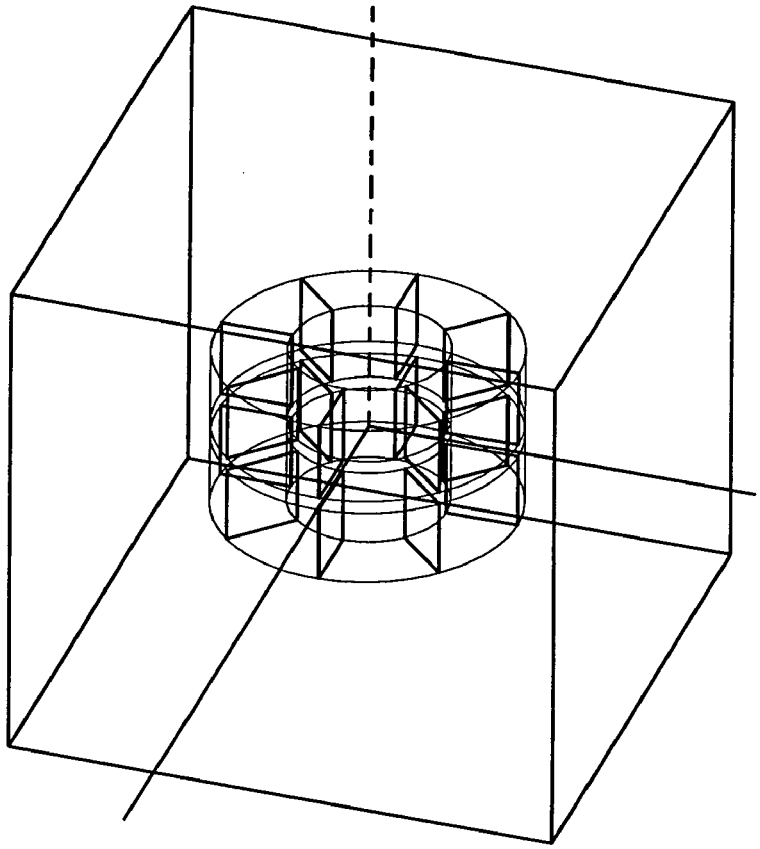
FIGS. 15A–15D are figures corresponding in content to FIGS. 14A–14D, but pertaining to a dielectric resonator circuit design identical to the dielectric resonator circuit design of FIG. 11A, except for the addition of eight, equally-spaced, vertical, radial, through slits of 0.1 mm width and one horizontal, radial, through slit of 0.1 mm width.
Figure 15B:
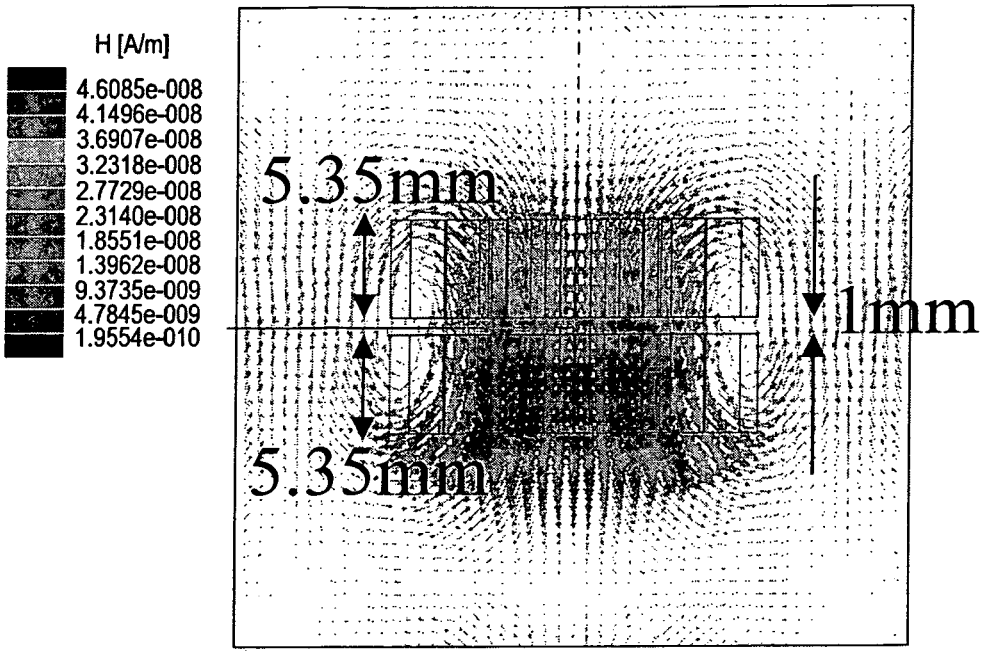
Figure 15C:
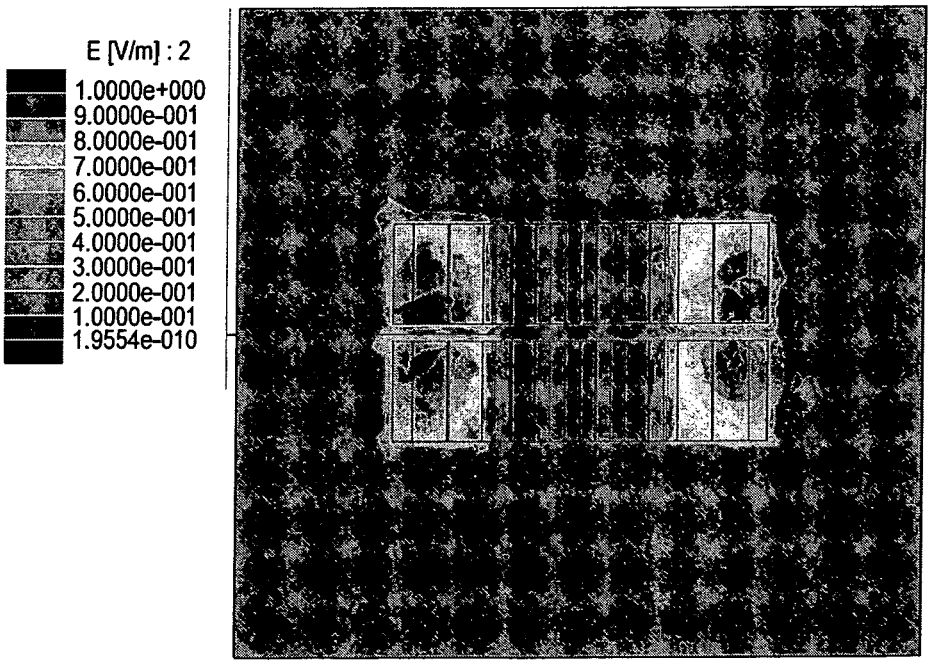

Another experimental simulation demonstrates the efficacy of this aspect of the invention. Particularly, FIG. 14A is a transparent isometric view of a conventional dielectric resonator circuit similar to the one shown in FIG. 11A, except having a bigger housing (cavity). FIGS. 14B and 14C are cross-sectional, side elevation views showing the magnetic and electric fields similar to the corresponding figures pertaining to the previous examples. FIG. 14D is a table showing the frequencies of the two fundamental modes. As shown, the TE mode has a Q of 4,800 at 1.960 GHz. The $H_{11}$ mode is at 2.691 GHz.

FIGS. 15A–15D show similar information as FIGS. 14A–14D, respectively, for a circuit similar to the circuit of FIG. 14A, except with the addition of 8 vertical slits of 0.1 millimeter and 1 horizontal slit of 0.1 millimeter. The Q is increased by almost 100% to 9,000 and the center frequency of the fundamental TE mode is increased by about 50% to 2.860 GHz. However, there is no mode separation problem because the horizontal slit has increased the frequency of the electric type modes also, including the $H_{11}$ mode. In fact, the $H_{11}$ mode, which was 2.691 GHz in the conventional circuit of FIG. 14, is no longer even the second lowest mode. The second lowest mode is now the second order TE mode at 3.974 GHz. That is more than 1.1 GHz higher than the frequency of the fundamental mode. Furthermore, the TE mode is not even a dangerous mode. The $H_{11}$ mode has been moved to a frequency even higher than 3.974 GHz and is, therefore, well spaced away from the frequency of the fundamental mode.

FIGS. 16A–16C and 17A–17C demonstrate another advantage of the present invention. Particularly, they demonstrate that, in addition to all of the previously mentioned advantages of the present invention, the slits also increase coupling strength between the resonators in a circuit, thus providing for even wider bandwidth of circuits incorporating the present invention. Particularly, FIGS. 16A and 16B are plan and side elevation views, respectively, of a two-pole dielectric resonator filter having the dimensions disclosed in the figures. FIG. 16C is a table showing the frequencies of the two lowest order modes. The resonators are conventional in that they do not incorporate any slits. At a fundamental TE mode frequency of 1.988 GHz, with a Q of approximately 2,400, coupling strength is 110 MHz.

FIGS. 17A–17C show similar information to FIGS. 16A–16C for a circuit identical to the circuit shown in FIGS. 16A–16C, except for the addition of four vertical radial slits of 0.2 millimeter gap. The frequency of the fundamental TE mode has been increased from 1.987 GHz to 2.392 GHz and the Q has been increased from approximately 2,400 to approximately 2,900. In addition, coupling strength has increased from 110 MHz to 150 MHz.

Having thus described a few particular embodiments of the invention, various alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A dielectric resonator circuit having an operational mode, said circuit comprising a dielectric resonator having a body formed of a dielectric material, said body having at least one slit defining a gap in the body such that a line of the electric field of the operational mode passes from the dielectric resonator body into the gap and back into the dielectric resonator body, wherein said slit is between 100 to 1000 atoms of said dielectric material wide.

2. The dielectric resonator circuit of claim 1 wherein the at least one slit has a width defined in the direction parallel to the electric field of the operational mode and a plane defined perpendicular to said width.

3. The dielectric resonator circuit of claim 2 wherein said plane of said at least one slit is perpendicular to the electric field of the operational mode.

4. The dielectric resonator circuit of claim 2 wherein the gap has a dielectric constant lower than a dielectric constant of the dielectric material.

5. The dielectric resonator circuit of claim 4 wherein the gap is comprised of air.

6. The dielectric resonator circuit of claim 4 wherein the gap is comprised of a vacuum.

7. The dielectric resonator circuit of claim 1 wherein the at least one slit comprises a plurality of slits comprising an integer multiple of 2.

8. The dielectric resonator circuit of claim 7 wherein the planes of the plurality of slits are vertical, radial, and uniformly radially spaced around said resonator body.

9. The dielectric resonator circuit of claim 2 wherein the at least one slit has a uniform width in the direction perpendicular to the electric field of the operational mode.

10. The dielectric resonator circuit of claim 2 wherein the at least one slit has a substantially uniform average width.

11. The dielectric resonator circuit of claim 10 wherein the at least one slit is defined by two adjacent surfaces of the dielectric resonator body that are in contact with each other, wherein the two surfaces are rough and define said gap having an average width between the two surfaces.

12. The dielectric resonator circuit of claim 1 wherein the dielectric resonator body defines a longitudinal direction, said body further comprising a central longitudinal through hole defining an inner circumferential wall and further comprising an outer circumferential wall and wherein said at least one slit is oriented parallel to said longitudinal axis and defining a gap in the circumferential direction, and wherein said slit runs completely through said dielectric resonator from said inner circumferential wall to said outer circumferential wall.

13. The dielectric resonator circuit of claim 12 wherein said dielectric resonator body further defines a top surface and a bottom surface, both substantially perpendicular to the longitudinal direction, and wherein the at least one slit runs from the top surface to the bottom surface.

14. The dielectric resonator circuit of claim 13 wherein the dielectric resonator body comprises a plurality of discrete pieces.

15. The dielectric resonator circuit of claim 1 wherein the dielectric resonator body is unitary and the at least one slit is a blind slit.

16. The dielectric resonator circuit of claim 13 wherein the dielectric resonator body is conical.

17. The dielectric resonator circuit of claim 1 wherein the dielectric resonator body further comprises at least one other slit oriented perpendicular to said at least one slit.

18. The dielectric resonator circuit of claim 1 wherein the dielectric resonator body further comprises at least one other slit oriented such that a line of the electric field of a non-operational mode of the dielectric resonator circuit passes from the dielectric resonator body into the gap and back into the dielectric resonator body.

19. A dielectric resonator circuit having an operational mode and comprising at least one dielectric resonator formed of a dielectric material and defining a longitudinal axis, said dielectric resonator having at least one first slit defining a gap in the body through which the electric field of the operational mode passes, said at least one slit oriented parallel to the longitudinal axis and extending radially of the longitudinal axis, wherein said slit is between 100 and 1000 atoms of said dielectric material wide.

20. The dielectric resonator circuit of claim 19 wherein the at least one first slit comprises a plurality of first slits uniformly angularly distributed around said longitudinal axis.

21. The dielectric resonator circuit of claim 20 wherein the plurality of first slits comprises an integer multiple of 2 slits.

22. The dielectric resonator circuit of claim 20 further comprising at least one second slit oriented perpendicular to said longitudinal axis.

23. The dielectric resonator circuit of claim 19 wherein the dielectric resonator is cylindrical.

24. The dielectric resonator circuit of claim 19 wherein the gap has a dielectric constant lower than a dielectric constant of the dielectric material.

25. The dielectric resonator circuit of claim 19 wherein the at least one first slit has a uniform width in the direction perpendicular to the electric field of the operational mode.

* * * * *